US010866055B1

(12) United States Patent
Hensel

(10) Patent No.: US 10,866,055 B1
(45) Date of Patent: Dec. 15, 2020

(54) CROSSBOW TRIGGER SYSTEM

(71) Applicant: Barnett Outdoors, LLC, Tarpon Springs, FL (US)

(72) Inventor: Jonathan Hensel, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 16/674,122

(22) Filed: Nov. 5, 2019

Related U.S. Application Data

(60) Provisional application No. 62/755,814, filed on Nov. 5, 2018.

(51) Int. Cl.
*F41B 5/12* (2006.01)

(52) U.S. Cl.
CPC ..... *F41B 5/12* (2013.01)

(58) Field of Classification Search
CPC ..... F41B 5/00; F41B 5/12; F41B 5/123
USPC ..... 124/25
See application file for complete search history.

(56) References Cited

U.S. PATENT DOCUMENTS 5,085,200 A * 2/1992 Horton-Corcoran ..... F41B 5/1469 124/25
6,736,123 B1 * 5/2004 Summers ..... F41A 17/46 124/25
7,770,567 B1 * 8/2010 Yehle ..... F41A 17/46 124/25
10,401,117 B1 * 9/2019 Rowzie, Jr. ..... F41B 5/12
2009/0194086 A1 * 8/2009 Kempf ..... F41B 5/12 124/25
2010/0170489 A1 * 7/2010 Shepley ..... F41B 5/1469 124/25
2011/0197869 A1 * 8/2011 Matasic ..... F41B 5/12 124/25
2015/0144117 A1 * 5/2015 Khoshnood ..... F41B 5/1469 124/25
2015/0260477 A1 * 9/2015 Khoshnood ..... F41A 19/10 124/25
2016/0195373 A1 * 7/2016 Barnett ..... F41B 5/148 124/25
2017/0131059 A1 * 5/2017 McPherson ..... F41B 5/1469

* cited by examiner

*Primary Examiner* — John E Simms, Jr.
(74) *Attorney, Agent, or Firm* — Jones Walker LLP

(57) ABSTRACT

A crossbow trigger assembly with a nock sensor enabling the catch to release the crossbow string only when a nock of an arrow is properly engaging the crossbow string. The trigger assembly also contains a bypass feature for deactivating the nock sensor to cause release of the crossbow string from the catch when a user activates a release switch. The bypass feature can only be activated when retractable hooks are positioned to receive the crossbow string near the catch, thereby preventing a dry fire of the crossbow string.

18 Claims, 31 Drawing Sheets

CROSSBOW TRIGGER SYSTEM

CROSS-REFERENCE TO RELATED APPLICATIONS

This application claims the benefit of and priority to U.S. Provisional Patent Application No. 62/755,814, filed on Nov. 5, 2018, which is incorporated by reference herein.

SUMMARY OF THE DISCLOSURE

The present disclosure is directed to an embodiment of a crossbow trigger system that may include a nock sensor. The nock sensor may include an axle portion with a nock pivot bore for pivotal movement of the nock sensor about a nock sensor pivot pin accommodated within the nock pivot bore. The nock sensor may include a wheel portion fixedly disposed around a center section of the axle portion. The wheel portion may include an upper peak section and a lower peak section. The axle portion may include opposing outer ends. Each end of the axle portion may contain an arm extending from an underside of the axle portion to a base support that traverses the arms. One of the arms may include an outer extension member. The base support may have a top and a bottom. The base support may include a central extension member extending from the bottom of the base support. The nock sensor pivot pin may be operatively associated with a nock spring that biases the nock sensor in a first pivoting direction. The upper peak section of the wheel portion may be operatively positioned within a gap between two hook portions of a catch that retain a bowstring in a firing position. The upper peak section of the wheel may be configured to receive a nock affixed to a rearward end of an arrow. When the nock sensor has not received the nock, the nock sensor may prevent actuation of the catch to release the bowstring for firing. When the nock sensor has received the nock, the nock sensor may enable actuation of the catch to release the bowstring for firing.

In another embodiment of the crossbow trigger system, the upper peak section of the nock sensor may contain a concave forward surface.

In yet another embodiment of the crossbow trigger system, the outer extension member of the nock sensor may contain a tapered rear surface.

In yet another embodiment of the crossbow trigger system, the central extension member of the nock sensor may contain a tapered forward surface.

In yet another embodiment of the crossbow trigger system, the system may further comprise a dry fire prevention assembly. The dry fire prevention assembly may comprise a bypass block, a release switch, and a lockout pawl. The bypass block may comprise a body portion having a top, a front, a rear, and outer and inner sides interconnecting the top and bottom. The outer side may contain a lockout notch. A bypass arm may longitudinally extend from the front and terminate at a distal end. The distal end may contain a bypass key configured to operatively contact the nock sensor. The front may be configured to receive an end of a bypass block spring that biases the bypass block in a rearward direction. The release switch may comprise a switch base having a forward end and a rearward end. The forward end may include a connection plate configured for operative connection to the bypass block. The rearward end may contain a switch control for selective reciprocation of the bypass block in forward and rearward directions. Selective reciprocation of the bypass block in the forward direction may cause the nock sensor to pivot in a second direction to disengage the base support of the nock sensor from a sear operatively associated with the catch to enable actuation of the catch to release the bowstring for firing. The lockout pawl may have a forward end, a rearward end, a top, a bottom, and outer and inner sides interconnecting the top and bottom. The forward end of the lockout pawl may contain a lockout pawl pivot bore extending through the top and bottom for pivotal movement of the lockout pawl about a lockout pawl pivot pin accommodated within the lockout pawl pivot bore. The inner side of the lockout pawl may include an extension portion and a tapered surface terminating at the rearward end. A lockout spring may bias the lockout pawl inwardly so that when the switch control has selectively reciprocated the bypass block in the rearward direction, the rearward end of the lockout pawl is disposed in the lockout notch of the bypass block preventing reciprocation of the bypass block in the forward direction.

In yet another embodiment of the crossbow trigger system, the system may further comprise an adapter operatively secured to the lockout pawl. The adapter may be configured for connection to a crossbow track. The crossbow track may be configured for sliding movement of a hook assembly. The hook assembly may include a hook pin. The hook pin may contact the extension portion of the lockout pawl when the hook assembly is slidably positioned on the crossbow track adjacent to the catch and disengage the rearward end of the lockout pawl from the lockout notch of the bypass block to enable the switch control of the release switch to selectively reciprocate the bypass block in the forward direction.

In yet another embodiment of the crossbow trigger system, the connection plate of the release switch may be operatively connected to the top of the bypass block.

In yet another embodiment of the crossbow trigger system, the bypass key may extend inwardly from the distal end of the bypass arm and operatively contact a rear surface of the outer extension of the nock sensor.

In yet another embodiment of the crossbow trigger system, the gap between the hook portions of the catch may be dimensioned to prevent accommodation of the nock unless the nock is oriented in a select position.

In yet another embodiment of the crossbow trigger system, the nock may include two opposing arms each containing an extended portion. The select position of the nock may comprise the arms of the nock being vertically aligned.

In yet another embodiment of the crossbow trigger system, the nock may be operatively fixed to an end of an arrow shaft. The arrow shaft may include a plurality of fletches. One of the plurality of fletches may be marked as an alignment fletch. The alignment fletch may be positioned within a channel of a crossbow track to achieve the select position of the nock.

The present disclosure is also directed to an alternative embodiment of a crossbow trigger system. The alternative system may comprise a trigger assembly. The trigger assembly may include a trigger lever and a trigger linkage. The trigger lever may have an upper end and a lower end. The lower end may include a contact surface configured for placement of a user's trigger finger. The trigger linkage may have a first end and a second end. The first end of the trigger linkage may operatively connect to the upper end of the trigger lever. The trigger lever may include a trigger lever pivot opening for pivotal movement of the trigger lever about a trigger pivot pin accommodated within the trigger lever pivot opening.

The alternative system may also include a pawl. The pawl may include a central body portion having an upper section and a lower section, two eye sections extending from the lower section of the central body portion and spaced apart by a gap. Each eye section may contain an eye bore. A pivot arm portion may extend from a front of the upper section and a rear arm portion may extend from a rear of the upper section. The pivot arm portion may include a pawl pivot bore for pivotal movement of the pawl about a pawl pivot pin accommodated within the pawl pivot bore. The rear arm portion may include a pin pocket surface. The second end of the trigger linkage may be operatively positioned in the gap between the two eye sections of the pawl and operatively connected to the pawl by a pawl linkage pin.

The alternative system may also include a sear. The sear may include a forward portion, a central portion, and a rearward portion. The rearward portion may have an upper spring surface interposed between a forward shoulder and a rearward shoulder. The upper spring surface may be configured to receive an end of a spring that biases the rearward portion downwardly to enable a pivoting of the sear in a first direction. The upper surface of the rearward portion may include a forward shoulder spaced apart from the rearward shoulder. The central portion may include a central pivot bore for pivotal movement of the sear about a sear pivot pin accommodated within the central pivot bore. The forward portion of the sear may include an upper catch surface terminating at a catch shoulder and a lower surface comprising first and second lower surface sections separated by a safety ridge section. The forward portion may include an upper forward portion arm and a lower forward portion arm separated by a cavity. The upper forward portion arm may extend beyond the lower forward portion arm and terminate at a nock sensor extension section. The lower forward portion arm may include an upper surface partially defining the cavity. The upper surface of the lower forward portion arm may be configured to cooperate with the pin pocket surface of the pawl.

The alternative system may also include a catch. The catch may include a vertical portion and a canopy portion. The vertical portion may have an upper end section, a lower end section, a forward surface section and a rearward surface section. The upper end section may contain a catch pivot bore for pivotal movement of the catch about a catch pivot pin accommodated within the catch pivot bore. The lower end section may include a sear pin surface operatively associated with the upper catch surface and catch shoulder of the sear and selectively displaceable therefrom. The canopy portion may include two hook portions extending downwardly from the canopy portion and spaced apart by a gap. Each of the hook portions may include a rear surface for selective retention of a bowstring in a cocked or firing position. The rearward surface section may be configured to receive an end of a catch spring that biases the catch to enable a pivoting of the catch in a first direction.

The alternative system may also include a nock sensor. The nock sensor may include an axle portion with a nock pivot bore for pivotal movement of the nock sensor about a nock sensor pivot pin accommodated with the nock pivot bore. The nock sensor may include a wheel portion fixedly disposed around a center section of the axle portion. The wheel portion may include an upper peak section and a lower peak section. The axle portion may include opposing outer ends. Each end of the axle portion may contain an arm extending from an underside of the axle portion to a base support traversing the arms. One of the arms may include an outer extension member. The base support may have a top and a bottom. The base support may include a central extension member extending from the bottom of the base support. The nock sensor pivot pin may be operatively associated with a nock spring that biases the nock sensor in a first pivoting direction. The upper peak section of the wheel portion may be operatively positioned within the gap of the catch and configured to receive a nock affixed to a rearward end of an arrow. When the nock sensor has not received the nock, the nock sensor extension of the sear may operatively contact the base support of the nock sensor to prevent actuation of the catch to release the bowstring for firing. When the nock sensor has received the nock to permit pivoting of the nock sensor in a second direction, the base support of the nock sensor may not operatively contact the nock sensor extension of the sear enabling actuation of the catch to release the bowstring for firing.

In another embodiment of the alternative system, the system may further comprise a safety. The safety may include a U-shaped body comprising two arms each with an upper end and a lower end. The lower end of the arms may be interconnected by a base member. Each arm may contain a safety pivot bore in axial alignment for pivotal movement of the safety about a safety pivot pin accommodated within the safety pivot bores. One or both of the upper ends may include a knob configured to pivot the safety by manipulation of the knob from a safety-on position to a safety-off position. In the safety-on position, the base support of the safety may operatively contact the safety ridge section of the sear to prevent actuation of the catch to release the bowstring for firing. In the safety-off position, the base support of the safety does not operatively contact the safety ridge of the sear to enable actuation of the catch to release the bowstring for firing.

In another embodiment of the alternative system, the upper peak of the nock sensor may contain a concave forward surface.

In another embodiment of the alternative system, the outer extension member of the nock sensor may contain a tapered rear surface.

In another embodiment of the alternative system, the central extension member of the nock sensor may contain a tapered forward surface.

The present disclosure is also directed to yet another alternative embodiment of a crossbow trigger system. The alternative system may comprise a trigger assembly. The trigger assembly may include a trigger lever and a trigger linkage. The trigger lever may have an upper end and a lower end. The lower end may include a contact surface configured for placement of a user's trigger finger. The trigger linkage may have a first end and a second end. The first end of the trigger linkage may operatively connect to the upper end of the trigger lever. The trigger lever may include a trigger lever pivot opening for pivotal movement of the trigger lever about a trigger pivot pin accommodated within the trigger lever pivot opening.

The further alternative system may also include a pawl. The pawl may include a central body portion having an upper section and a lower section, two eye sections extending from the lower section of the central body portion and spaced apart by a gap. Each eye section may contain an eye bore. A pivot arm portion may extend from a front of the upper section and a rear arm portion may extend from a rear of the upper section. The pivot arm portion may include a pawl pivot bore for pivotal movement of the pawl about a pawl pivot pin accommodated within the pawl pivot bore. The rear arm portion may include a pin pocket surface. The second end of the trigger linkage may be operatively positioned in the gap between the two eye sections of the pawl and operatively connected to the pawl by a pawl linkage pin.

The further alternative system may also include a sear. The sear may include a forward portion, a central portion, and a rearward portion. The rearward portion may have an upper spring surface interposed between a forward shoulder and a rearward shoulder. The upper spring surface may be configured to receive an end of a spring that biases the rearward portion downwardly to enable a pivoting of the sear in a first direction. The upper surface of the rearward portion may include a forward shoulder spaced apart from the rearward shoulder. The central portion may include a central pivot bore for pivotal movement of the sear about a sear pivot pin accommodated within the central pivot bore. The forward portion of the sear may include an upper catch surface terminating at a catch shoulder and a lower surface comprising first and second lower surface sections separated by a safety ridge section. The forward portion may include an upper forward portion arm and a lower forward portion arm separated by a cavity. The upper forward portion arm may extend beyond the lower forward portion arm and terminate at a nock sensor extension section. The lower forward portion arm may include an upper surface partially defining the cavity. The upper surface of the lower forward portion arm may be configured to cooperate with the pin pocket surface of the pawl.

The further alternative system may also include a catch. The catch may include a vertical portion and a canopy portion. The vertical portion may have an upper end section, a lower end section, a forward surface section and a rearward surface section. The upper end section may contain a catch pivot bore for pivotal movement of the catch about a catch pivot pin accommodated within the catch pivot bore. The lower end section may include a sear pin surface operatively associated with the upper catch surface and catch shoulder of the sear and selectively displaceable therefrom. The canopy portion may include two hook portions extending downwardly from the canopy portion and spaced apart by a gap. Each of the hook portions may include a rear surface for selective retention of a bowstring in a cocked or firing position. The rearward surface section may be configured to receive an end of a catch spring that biases the catch to enable a pivoting of the catch in a first direction.

The further alternative system may also include a nock sensor. The nock sensor may include an axle portion with a nock pivot bore for pivotal movement of the nock sensor about a nock sensor pivot pin accommodated with the nock pivot bore. The nock sensor may include a wheel portion fixedly disposed around a center section of the axle portion. The wheel portion may include an upper peak section and a lower peak section. The axle portion may include opposing outer ends. Each end of the axle portion may contain an arm extending from an underside of the axle portion to a base support traversing the arms. One of the arms may include an outer extension member. The base support may have a top and bottom. The base support may include a central extension member extending from the bottom of the base support. The nock sensor pivot pin may be operatively associated with a nock spring that biases the nock sensor in a first pivoting direction. The upper peak section of the wheel portion may be operatively positioned within the gap of the catch and configured to receive a nock affixed to a rearward end of an arrow. When the nock sensor has not received the nock, the nock sensor extension of the sear may operatively contact the base support of the nock sensor to prevent actuation of the catch to release the bowstring for firing. When the nock sensor has received the nock to permit pivoting of the nock sensor in a second direction, the base support of the nock sensor does not operatively contact the nock sensor extension of the sear enabling actuation of the catch to release the bowstring for firing.

The further alternative system may also include a dry fire prevention assembly. The dry fire prevention assembly may comprise a bypass block, a release switch, and a lockout pawl. The bypass block may comprise a body portion having a top, a front, a rear, and outer and inner sides interconnecting the top and bottom. The outer side may contain a lockout notch. A bypass arm may longitudinally extend from the front and terminate at a distal end. The distal end may contain a bypass key configured to operatively contact the nock sensor. The front may be configured to receive an end of a bypass block spring that biases the bypass block in a rearward direction. The release switch may comprise a switch base having a forward end and a rearward end. The forward end may include a connection plate configured for operative connection to the bypass block. The rearward end may contain a switch control for selective reciprocation of the bypass block in forward and rearward directions. Selective reciprocation of the bypass block in the forward direction may cause the nock sensor to pivot in the second direction to disengage the base support of the nock sensor from the nock sensor extension of the sear to enable actuation of the catch to release the bowstring for firing. The lockout pawl may have a forward end, a rearward end, a top, a bottom, and outer and inner sides interconnecting the top and bottom. The forward end of the lockout pawl may contain a lockout pawl pivot bore extending through the top and bottom for pivotal movement of the lockout pawl about a lockout pawl pivot pin accommodated within the lockout pawl pivot bore. The inner side of the lockout pawl may include an extension portion and a tapered surface terminating at the rearward end. A lockout spring may bias the lockout pawl inwardly so that when the switch control has selectively reciprocated the bypass block in the rearward direction, the rearward end of the lockout pawl is disposed in the lockout notch of the bypass block preventing reciprocation of the bypass block in the forward direction.

In another embodiment of the further alternative system, the system may further comprise an adapter operatively secured to the lockout pawl. The adapter may be configured for connection to a crossbow track. The crossbow track may be configured for sliding movement of a hook assembly. The hook assembly may include a hook pin. The hook pin may contact extension portion of the lockout pawl when the hook assembly is slidably positioned on the crossbow track adjacent to the catch and disengage the rearward end of the lockout pawl from the lockout notch of the bypass block to enable the switch control of the release switch to selectively reciprocate the bypass block in the forward direction.

In another embodiment of the further alternative system, the connection plate of the release switch may be operatively connected to the top of the bypass block.

In another embodiment of the further alternative system, the bypass key may extend inwardly from the distal end of the bypass arm and operatively contact a rear surface of the outer extension of the nock sensor.

In another embodiment of the further alternative system, the top of the body portion of the bypass block may be separated by a shoulder into a lower top section and an upper top section wherein the connection plate of the release switch may be operatively connected to the upper top section.

In another embodiment of the further alternative system, the front of the body portion of the bypass block may contain a recess for placement of the end of the bypass block spring.

In another embodiment of the further alternative system, a flat extension wall may extend from the front of the body portion of the bypass block.

In another embodiment of the further alternative system, the system may further comprise a safety. The safety may include a U-shaped body comprising two arms each with an upper end and a lower end. The lower end of the arms may be interconnected by a base member. Each arm may contain a safety pivot bore in axial alignment for pivotal movement of the safety about a safety pivot pin accommodated within the safety pivot bores. One or both of the upper ends may include a knob configured to pivot the safety by manipulation of the knob from a safety-on position to a safety-off position. In the safety-on position, the base support of the safety may operatively contact the safety ridge section of the sear to prevent actuation of the catch to release the bowstring for firing. In the safety-off position, the base support of the safety does not operatively contact the safety ridge of the sear to enable actuation of the catch to release the bowstring for firing.

DETAILED DESCRIPTION OF THE DISCLOSURE

Figure 1:
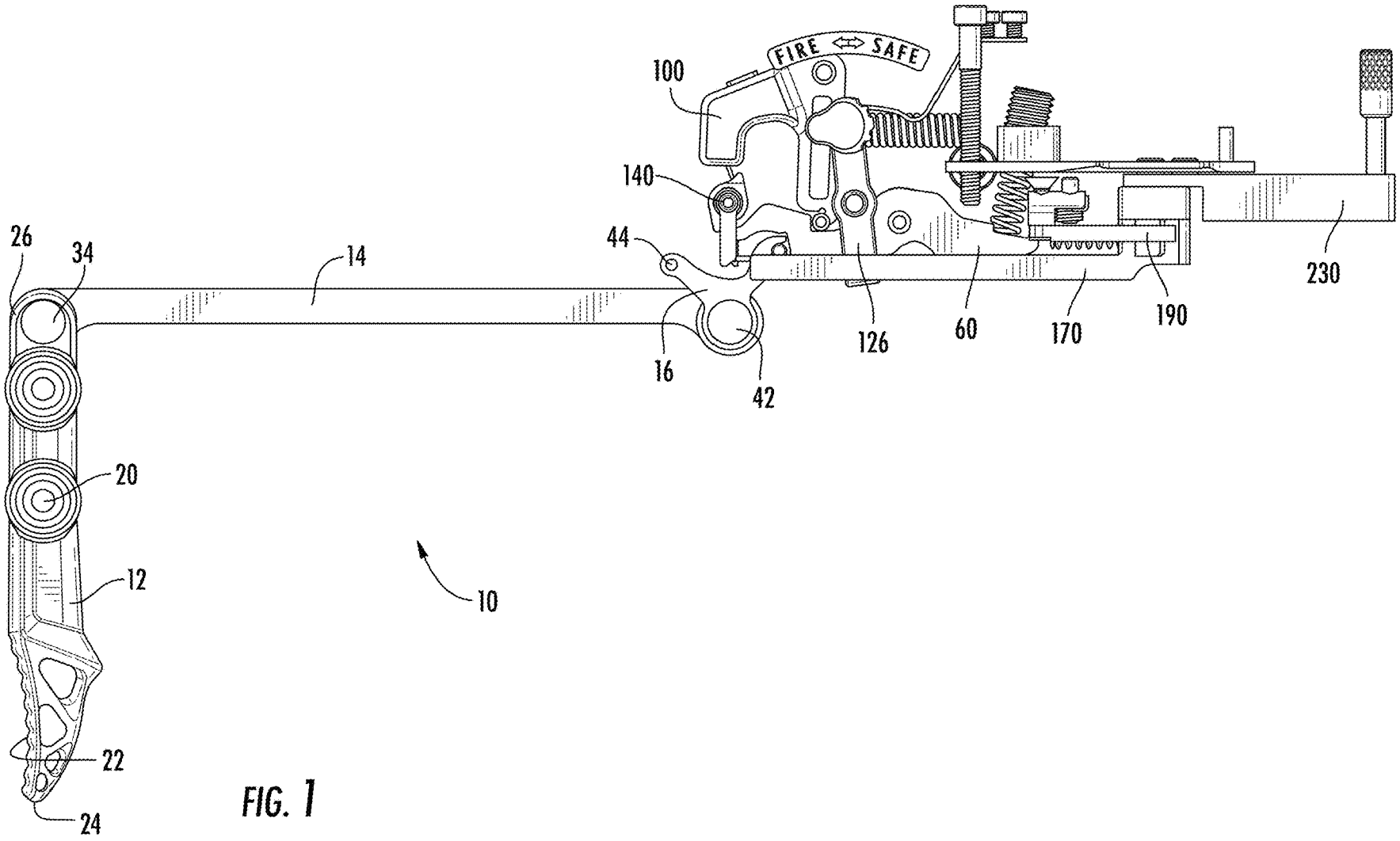
FIG. 1 is a side view of a crossbow trigger assembly.
Figure 2:
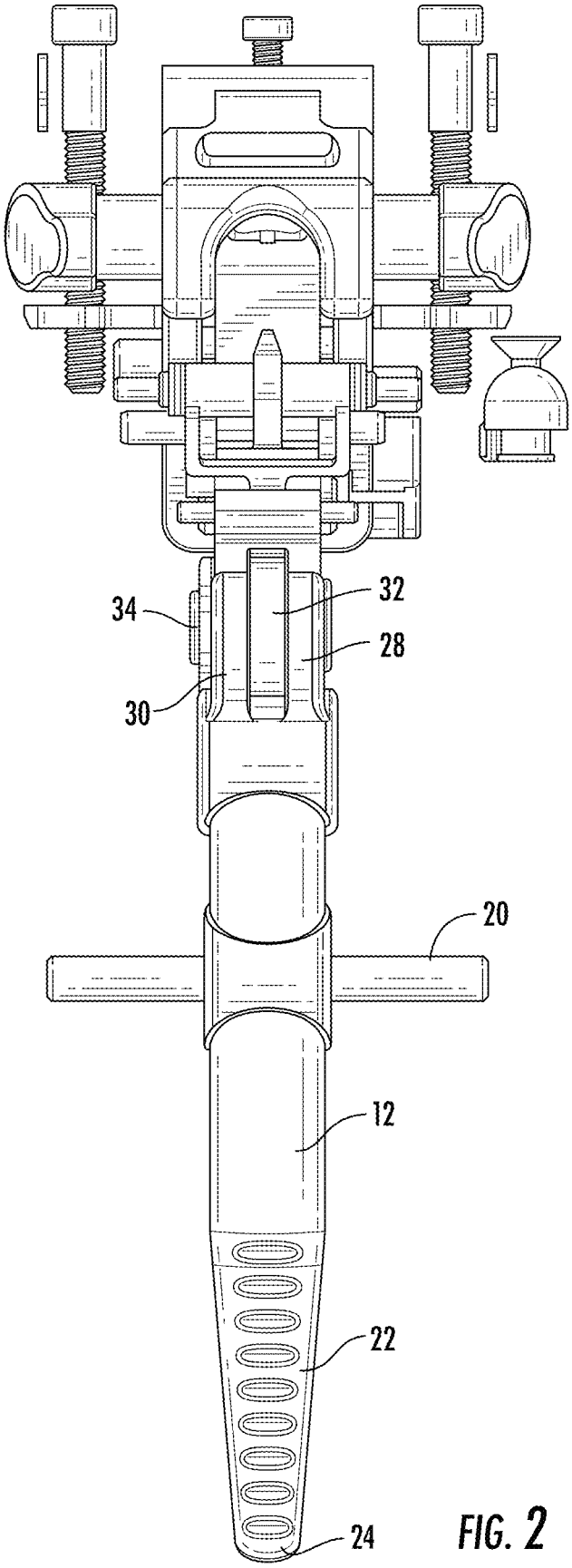
FIG. 2 is a front view of the trigger assembly.
Figure 3:
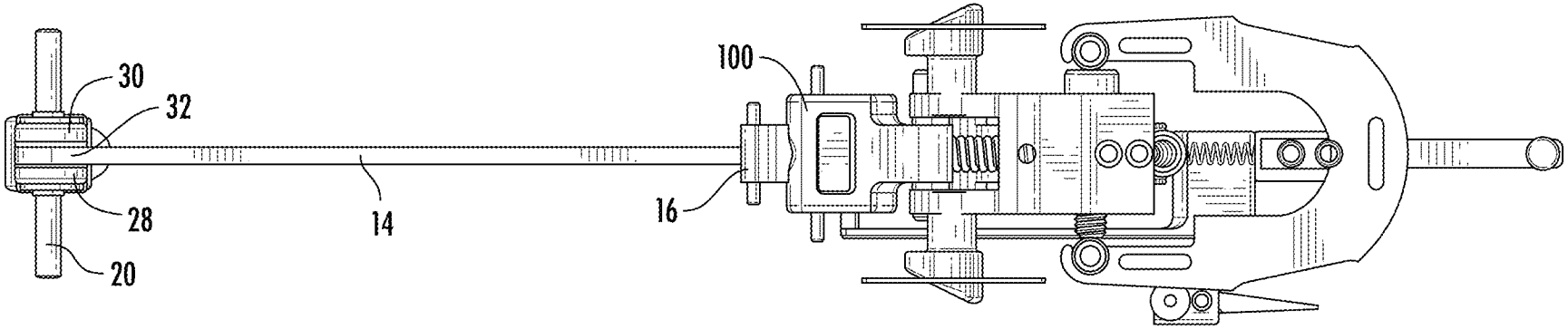
FIG. 3 is a top view of the trigger assembly.
Figure 4:
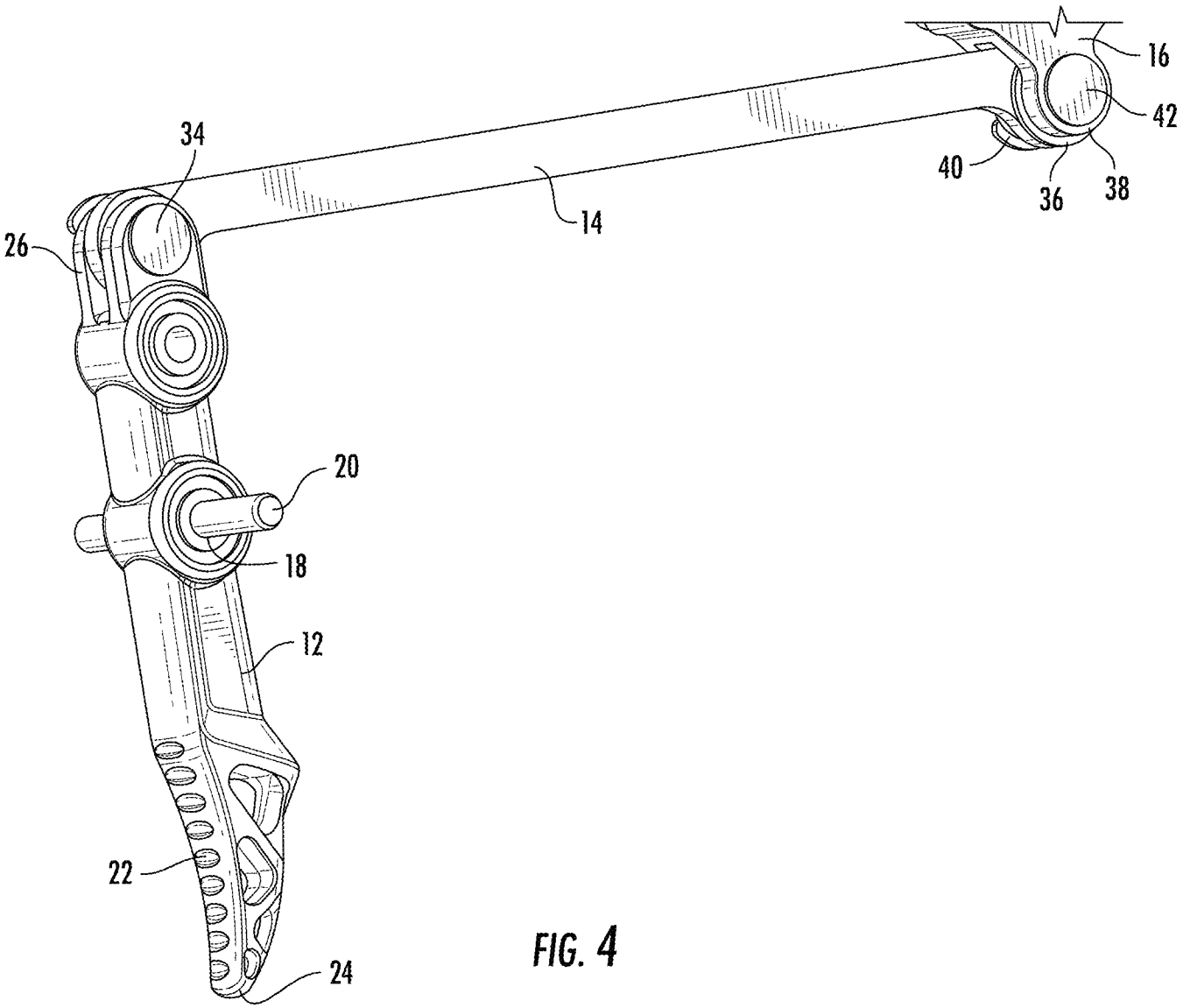
FIG. 4 is a perspective view of a trigger lever and a trigger linkage of the trigger assembly.

A crossbow trigger system has a trigger assembly that includes a safety mechanism that disables or enables the firing of a crossbow string (e.g. bowstring) held within a catch of the trigger assembly. The trigger assembly may also include a nock sensor enabling the catch to release the crossbow string only when a nock of an arrow is properly engaging the crossbow string. The trigger assembly may also be configured to bypass the nock sensor to release the crossbow string from the catch when a user activates a release switch. The bypass feature may only be activated when retractable hooks are positioned to receive the crossbow string near the catch, thereby preventing a dry fire of the crossbow string. The retractable hooks provide a controlled movement of the crossbow string from the cocked position into the uncocked position (e.g., by rotation of a crank cocking device to move the hooks forward along the crossbow's track). In other words, the trigger assembly eliminates the need to dry fire the crossbow by providing a manner of deactivating the nock sensor to allow the crossbow string to be released onto sliding hook components, which can then be cranked back to a starting position. A sear of the trigger assembly may have an adjustable sensitivity. The trigger assembly is designed to reduce the trigger movement required to release the crossbow string from the catch.

References herein to clockwise or counterclockwise pivoting of component parts of trigger assembly 10 is intended to mean in relation a left side view of trigger assembly 10 as configured on a crossbow.

With reference to FIGS. 1-4, crossbow trigger assembly 10 may include trigger lever 12 pivotally connected to trigger linkage 14, which is in turn pivotally connected to pawl 16. Trigger lever 12 includes pivot opening 18. Trigger pivot pin 20 may be secured through pivot opening 18 with each end of trigger pivot pin 20 secured in an aperture or groove of a housing to secure trigger lever 12 in the housing. When a user applies a rearward force on contact surface 22 of trigger lever 12, trigger lever 12 pivots in a first or counterclockwise direction about trigger pivot pin 20 such that lower end 24 of trigger lever 12 moves in a rearward direction and upper end 26 of trigger lever 12 moves in a forward direction. Upper end 26 may include first eye 28 and second eye 30. Trigger linkage 14 may include eye 32 positioned between first and second eyes 28 and 30 of trigger lever 12, thereby creating a bore configured to house linkage pin 34. Linkage pin 34 secures trigger linkage 14 to trigger lever 12. When a user pulls contact surface 22 of trigger lever 12 rearward, upper end 26 of trigger lever 12 pulls trigger linkage 14 in the forward direction. Linkage pin 34 provides for relative rotation between trigger linkage 14 and trigger lever 12 in this forward movement. The second end of trigger linkage 14 includes eye 36 disposed between first eye 38 and second eye 40 of pawl 16, thereby creating a bore configured to house pawl linkage pin 42. Pawl pivot pin 44 is secured through an aperture in pawl 16, with each end of pawl pivot pin 44 secured in an aperture or groove of a housing to secure pawl 16 in the housing. When trigger linkage 14 is pulled in the forward direction, pawl linkage pin 42 rotates pawl 16 in a first or clockwise direction about pawl pivot pin 44. Pawl linkage pin 42 provides for relative rotation between trigger linkage 14 and pawl 16.

Figure 5:
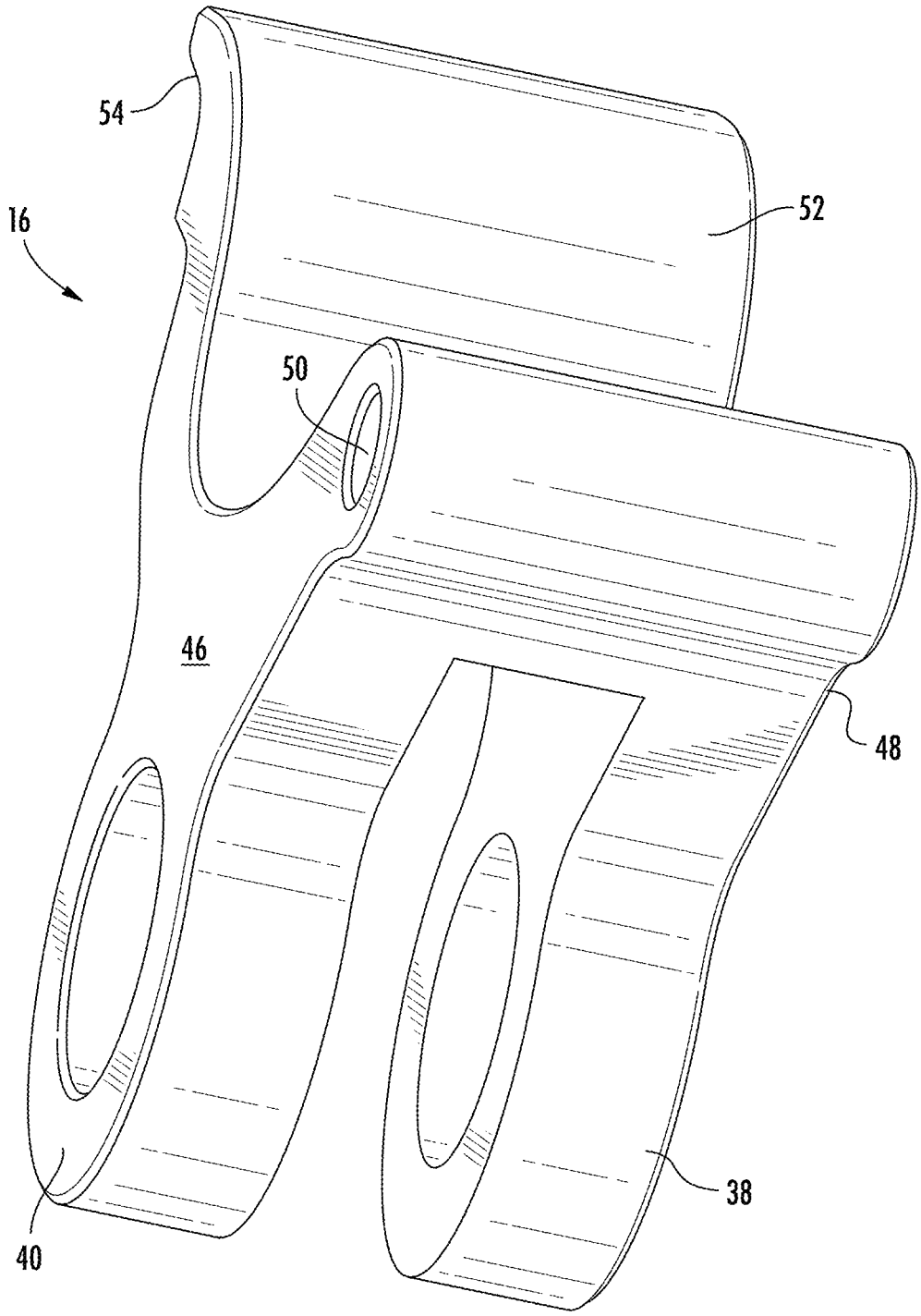
FIG. 5 is a front perspective view of a pawl of the trigger assembly.
Figure 6:
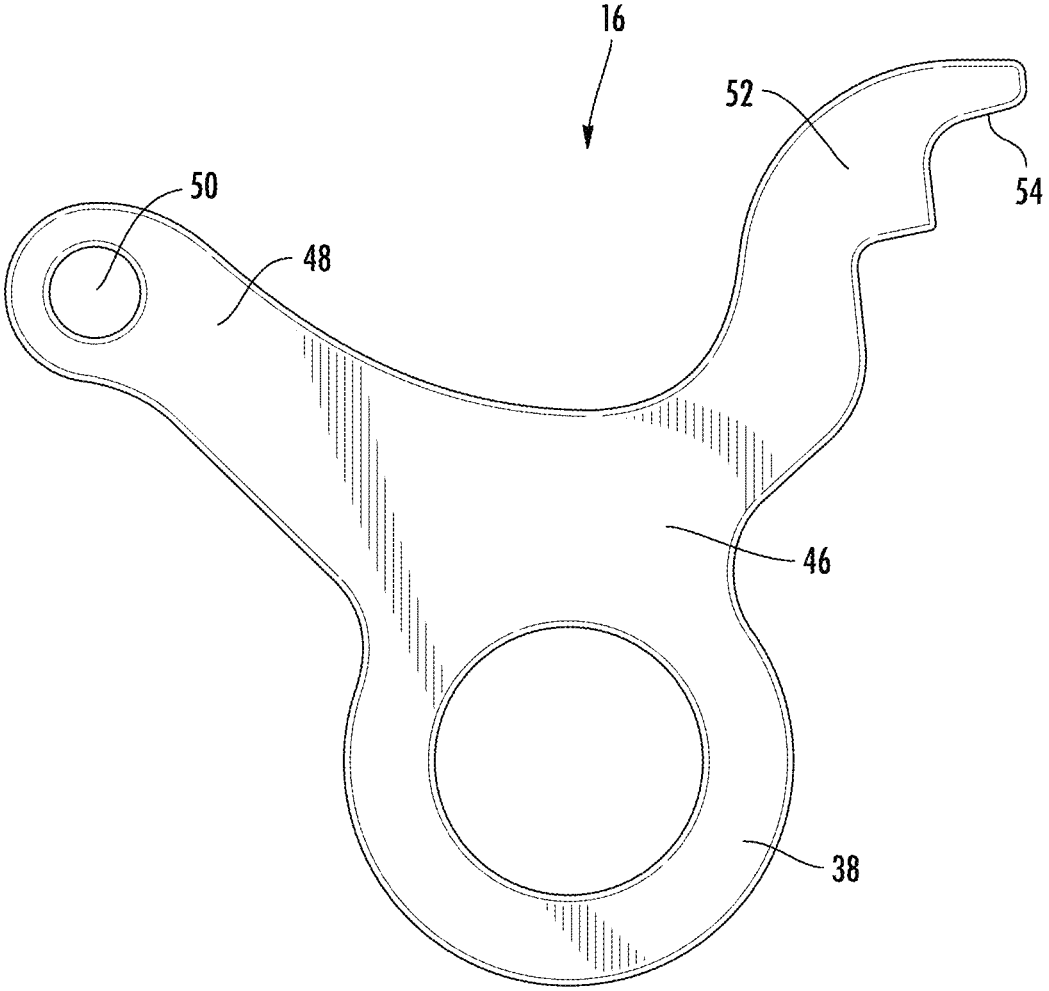
FIG. 6 is a side view of the pawl.

FIGS. 5 and 6 illustrate pawl 16 including central body portion 46 with first and second eyes 38 and 40 extending below central body portion 46. Pawl 16 also includes pivot portion 48 extending forward of central body portion 46. Pivot portion 48 includes pivot pin bore 50 configured to house pawl pivot pin 44 as shown in FIGS. 1-4. Pawl 16 further includes rear portion 52 extending in a rearward direction from central body portion 46. Rear portion 52 includes pin pocket 54 adjacent to the rearward end of pawl 16.

Figure 7:
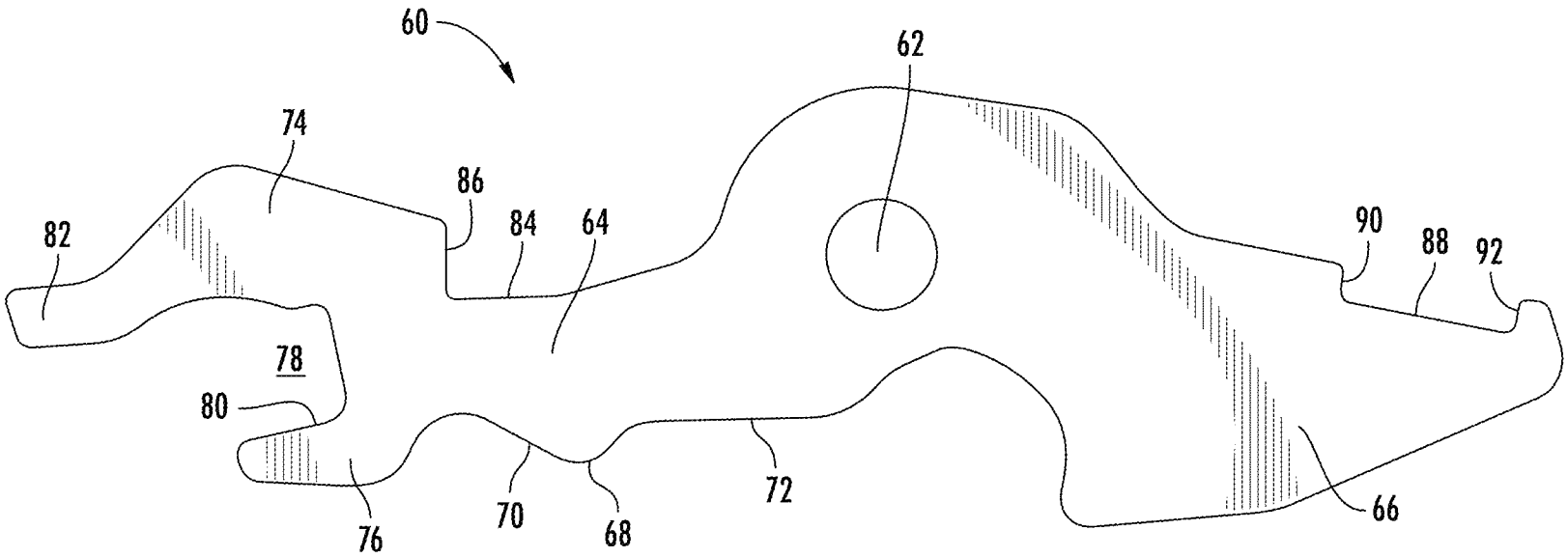
FIG. 7 is a side view of a sear of the trigger assembly.
Figure 8:
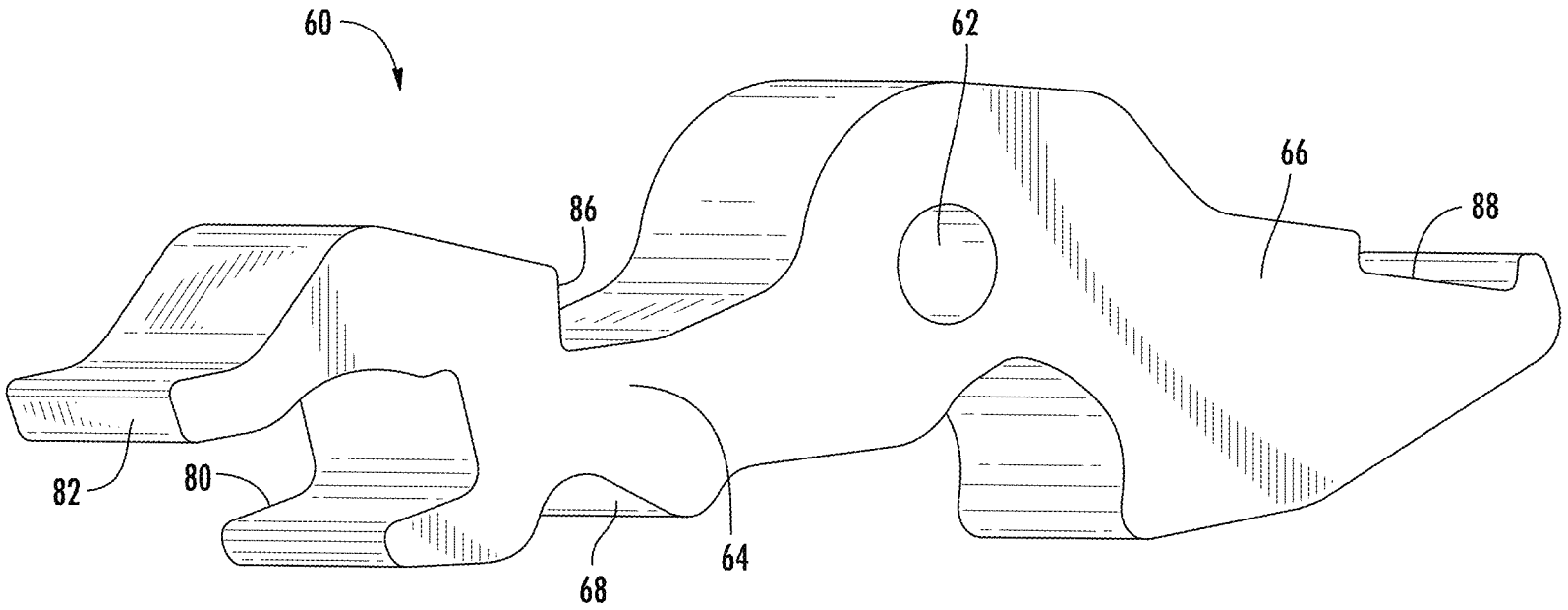
FIG. 8 is a front perspective view of the sear.
Figure 9:
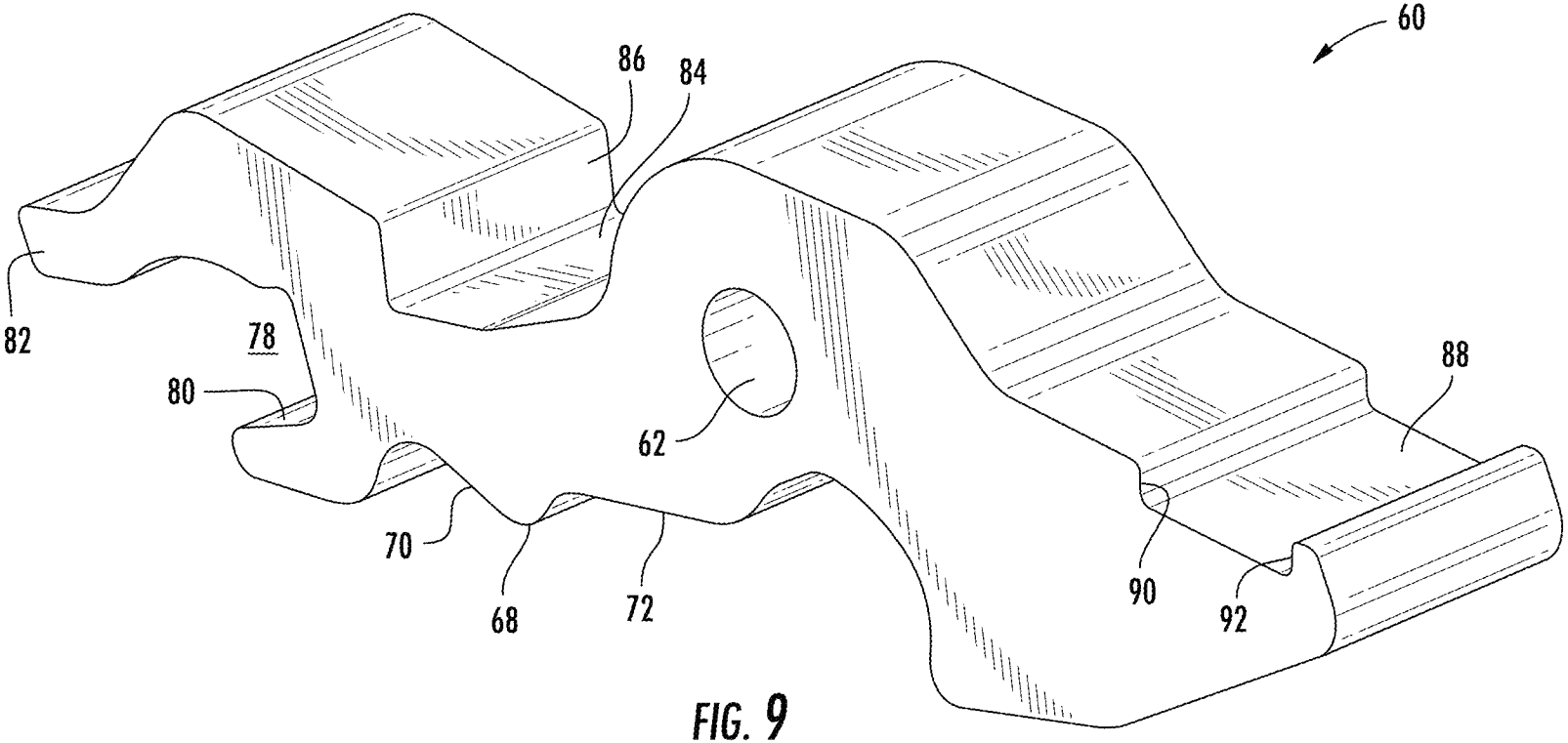
FIG. 9 is a rear perspective view of the sear.

With reference to FIGS. 7-9, trigger assembly 10 further includes sear 60. Sear 60 includes central pivot bore 62 between forward portion 64 and rearward portion 66. Central pivot bore 62 is configured to house a sear pivot pin. Each end of the sear pivot pin may be secured in an aperture or groove of a housing to secure sear 60 in the housing, and to provide for rotation of sear 60 about the sear pivot pin within the housing. Forward portion 64 of sear 60 includes safety ridge 68 between first lower surface 70 and second lower surface 72. Forward portion 64 may extend beyond first lower surface 70 to upper forward portion 74 and lower forward portion 76 separated by cavity 78. Upper surface 80 of lower forward portion 76 may be configured to cooperate with pin pocket 54 of pawl 16 to retain a pin, as described in more detail below. Upper forward portion 74 may extend to nock sensor extension 82, which is disposed forward of cavity 78. Sear 60 may include upper catch surface 84 above first lower surface 70. Upper catch surface 84 may extend to catch shoulder 86. Rearward portion 66 of sear 60 includes upper spring surface 88 bounded by forward shoulder 90 and rearward shoulder 92. Upper spring surface 88 is configured to receive an end of a compression spring designed to bias rearward portion 66 of sear 60 in a downward direction (i.e., to bias sear 60 toward a first or clockwise rotation).

Figure 10:
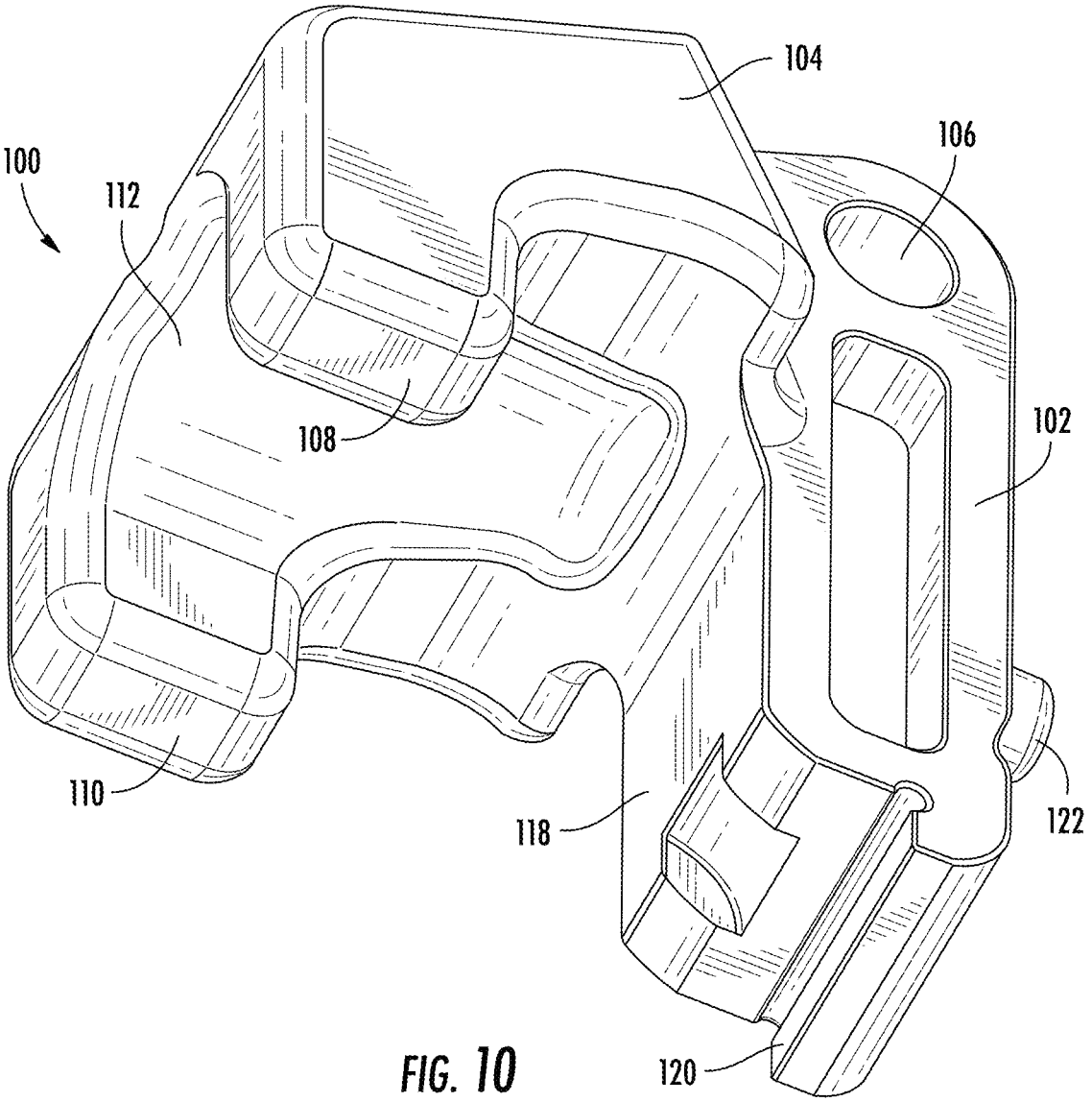
FIG. 10 is a bottom perspective view of a catch of the trigger assembly.
Figure 11:
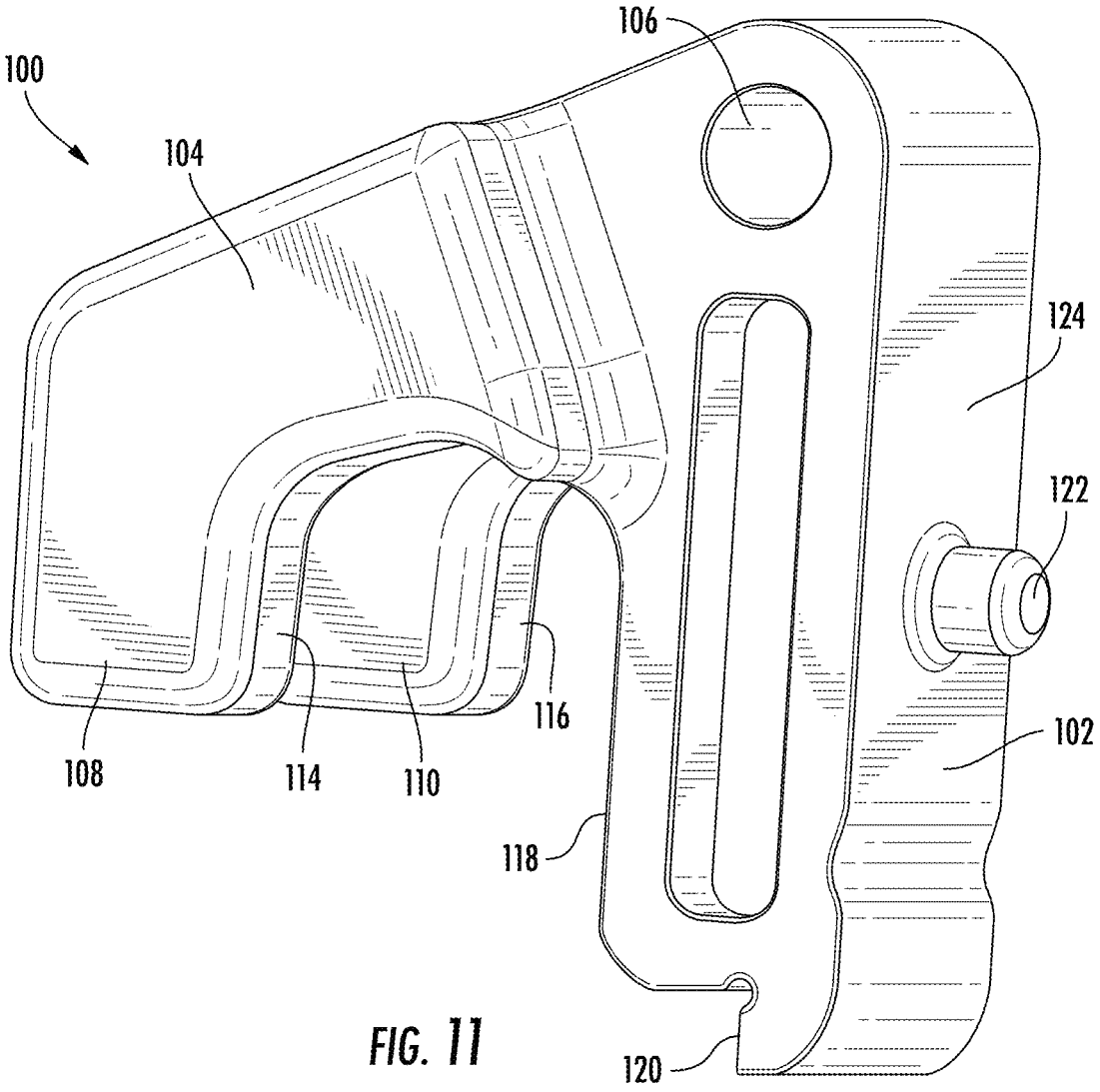
FIG. 11 is a side perspective view of the catch.

Referring now to FIGS. 10 and 11, catch 100 of trigger assembly 10 includes vertical portion 102 and canopy portion 104 extending forward from vertical portion 102. Pivot bore 106 extends through an upper end of vertical portion 102. Pivot bore 106 is configured to house a catch pivot pin. Each end of the catch pivot pin may be secured in an aperture or groove of a housing to secure catch 100 in the housing, and to provide for rotation of catch 100 about the catch pivot pin within the housing. Canopy portion 104 includes first hook portion 108 and second hook portion 110 separated by space 112. Rear surfaces 114 and 116 of first and second hook portions 108 and 110, respectively, are configured to retain a crossbow string in the cocked position. Vertical portion 102 includes forward surface 118 extending along the length of vertical portion 102. Sear pin surface 120 is disposed near the lower end of vertical portion 102. Sear pin surface 120 may be a forward surface of an extension formed at the lower end of vertical portion 102. Spring retainer 122 extends from rearward surface 124 of vertical portion 102.

Figure 12:
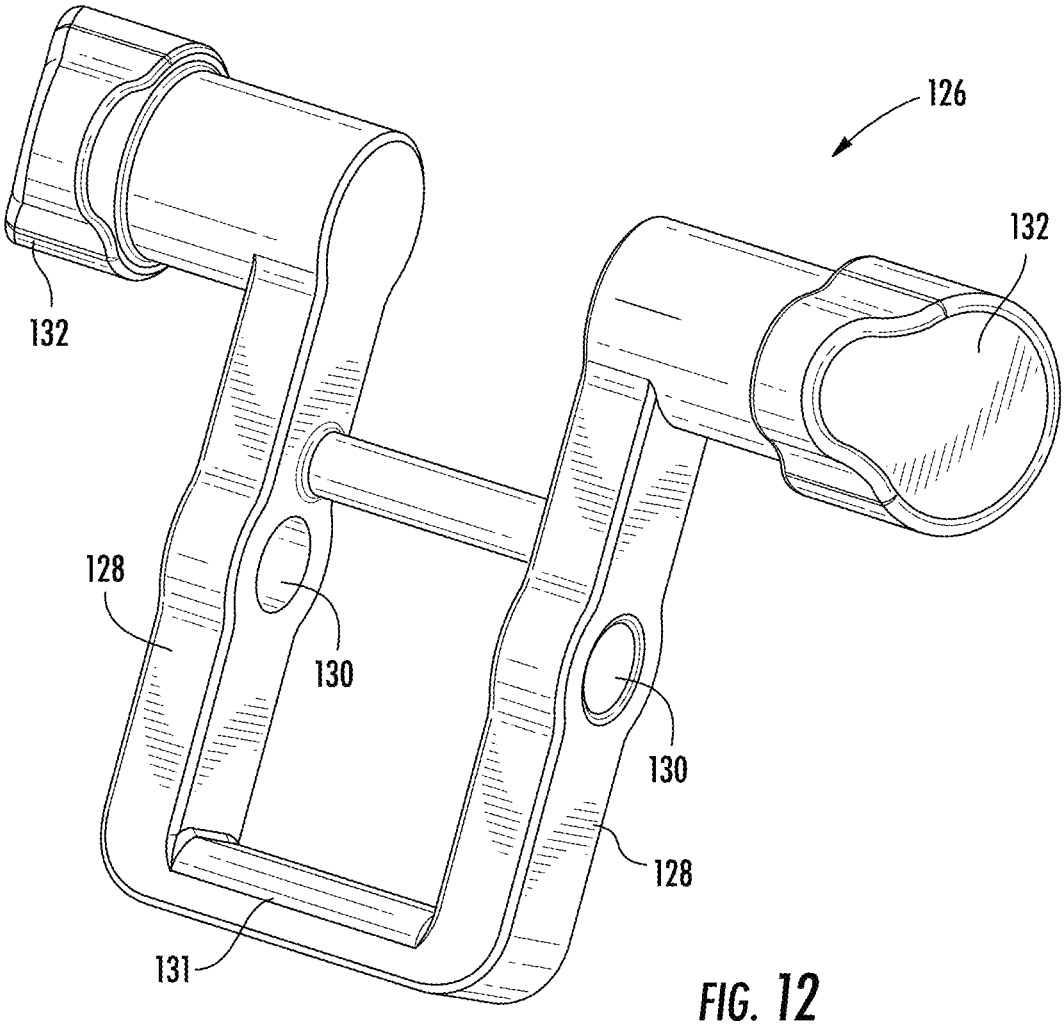
FIG. 12 is a perspective view of a safety of the trigger assembly.

With reference to FIG. 12, safety 126 of trigger assembly 10 includes U-shaped body with each arm 128 including a pivot bore 130. Pivot bores 130 are configured to house a safety pivot pin. Each end of the safety pivot pin may be secured in an aperture or groove of a housing to secure safety 126 in the housing, and to provide for rotation of safety 126 about the safety pivot pin within the housing. The lower ends of arms 128 are connected by base 131. The upper end of each arm 128 may extend in an outward direction to knob 132. A user may engage knobs 132 to engage and disengage safety 126 of trigger assembly 10.

Figure 13:
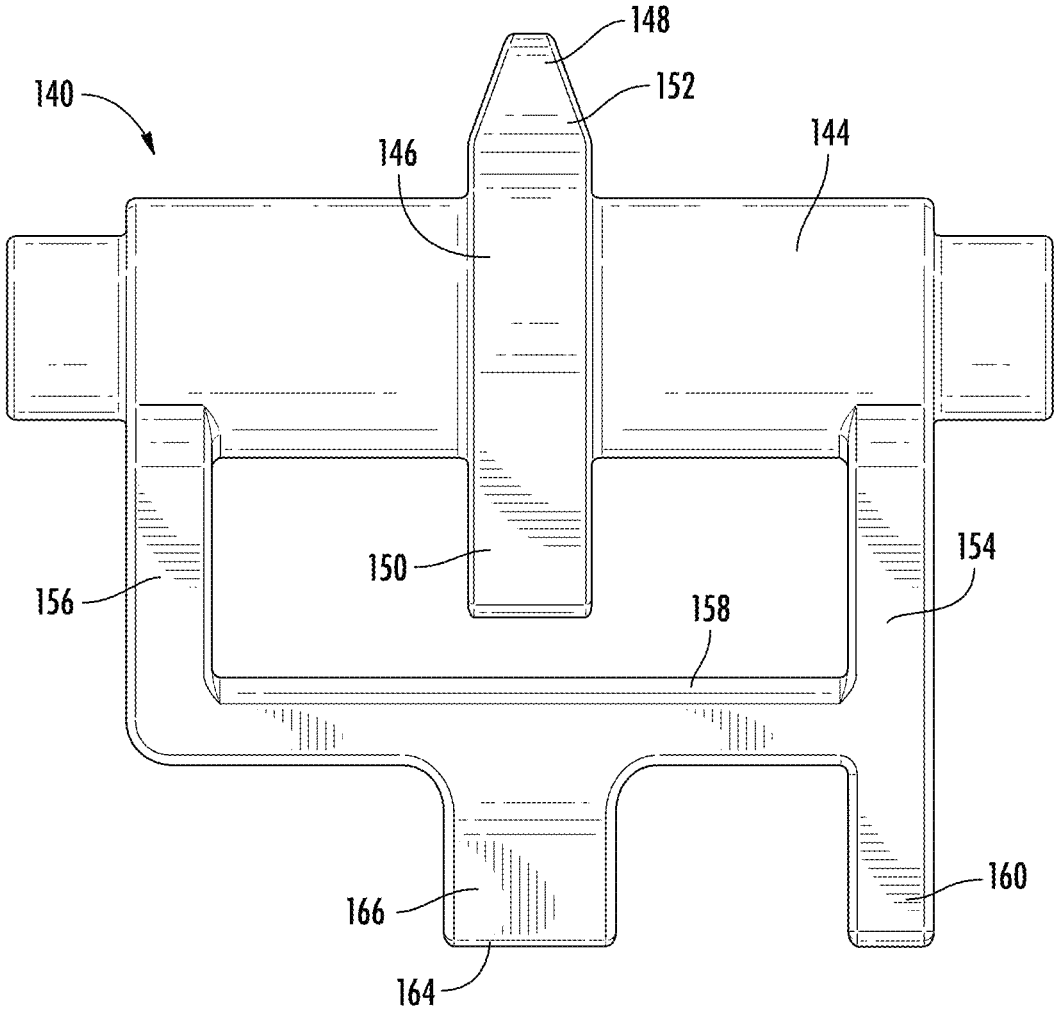
FIG. 13 is a front view of a nock sensor of the trigger assembly.
Figure 14:
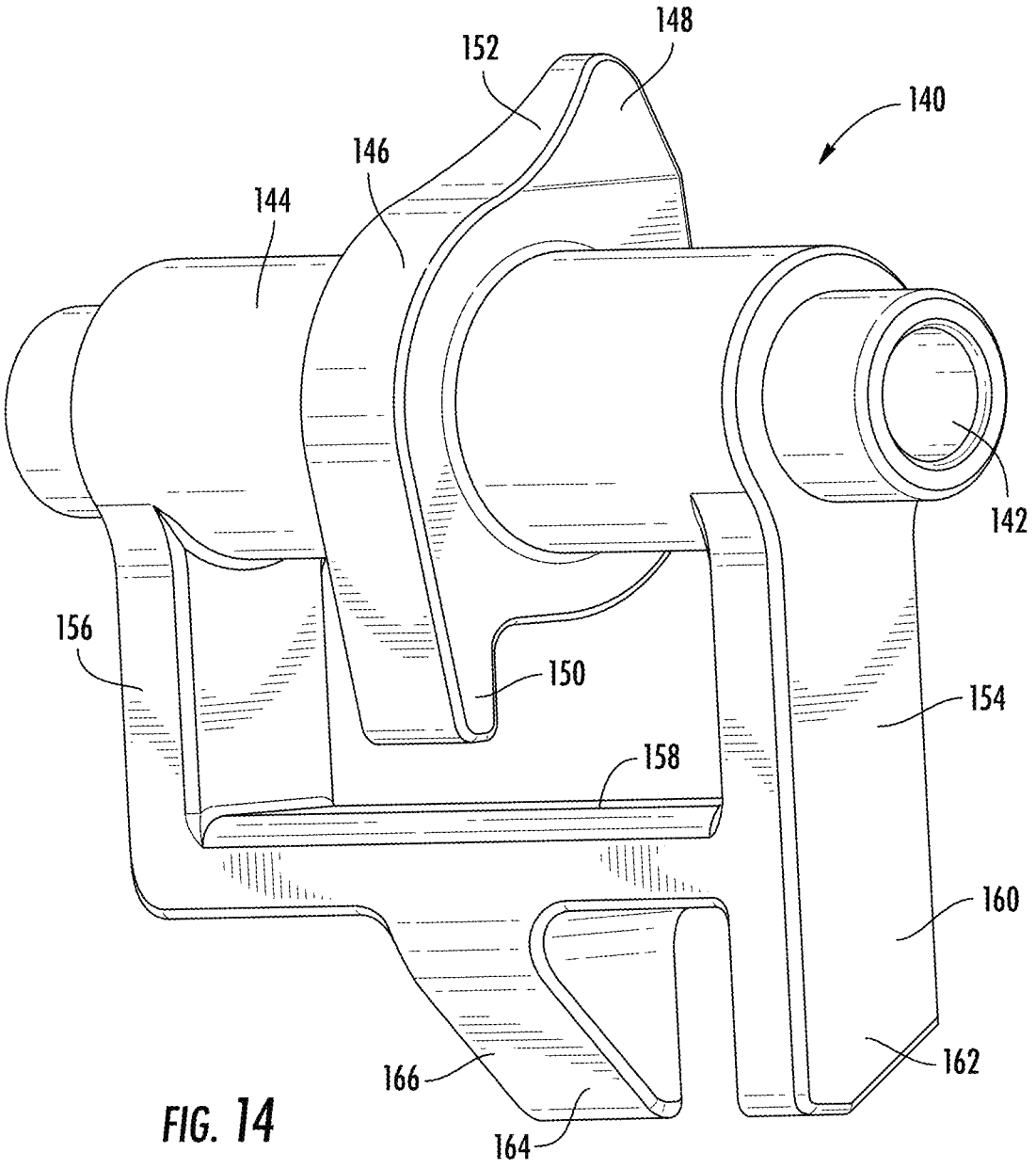
FIG. 14 is a perspective view of the nock sensor.

FIGS. 13 and 14 illustrate nock sensor 140 of trigger assembly 10. Nock sensor 140 includes pivot bore 142 extending through axle portion 144. Pivot bore 142 is configured to house a nock sensor pivot pin. Each end of the nock sensor pivot pin may be secured in an aperture or groove of a housing to secure nock sensor 140 in the housing, and to provide for rotation of nock sensor 140 about the nock sensor pivot pin within the housing. Wheel portion 146 may be disposed around the center of axle portion 144. Wheel portion 146 may include upper peak 148 and lower peak 150. Upper peak 148 may include concave forward surface 152. Arms 154 and 156 may extend below axle portion 144 with base 158 interconnecting arms 154 and 156. Arm 154 may extend below base 158 to form outer extension 160 having tapered rear surface 162. Central extension 164 may extend from the center of base 158. Central extension 164 may include tapered forward surface 166.

Figure 15:
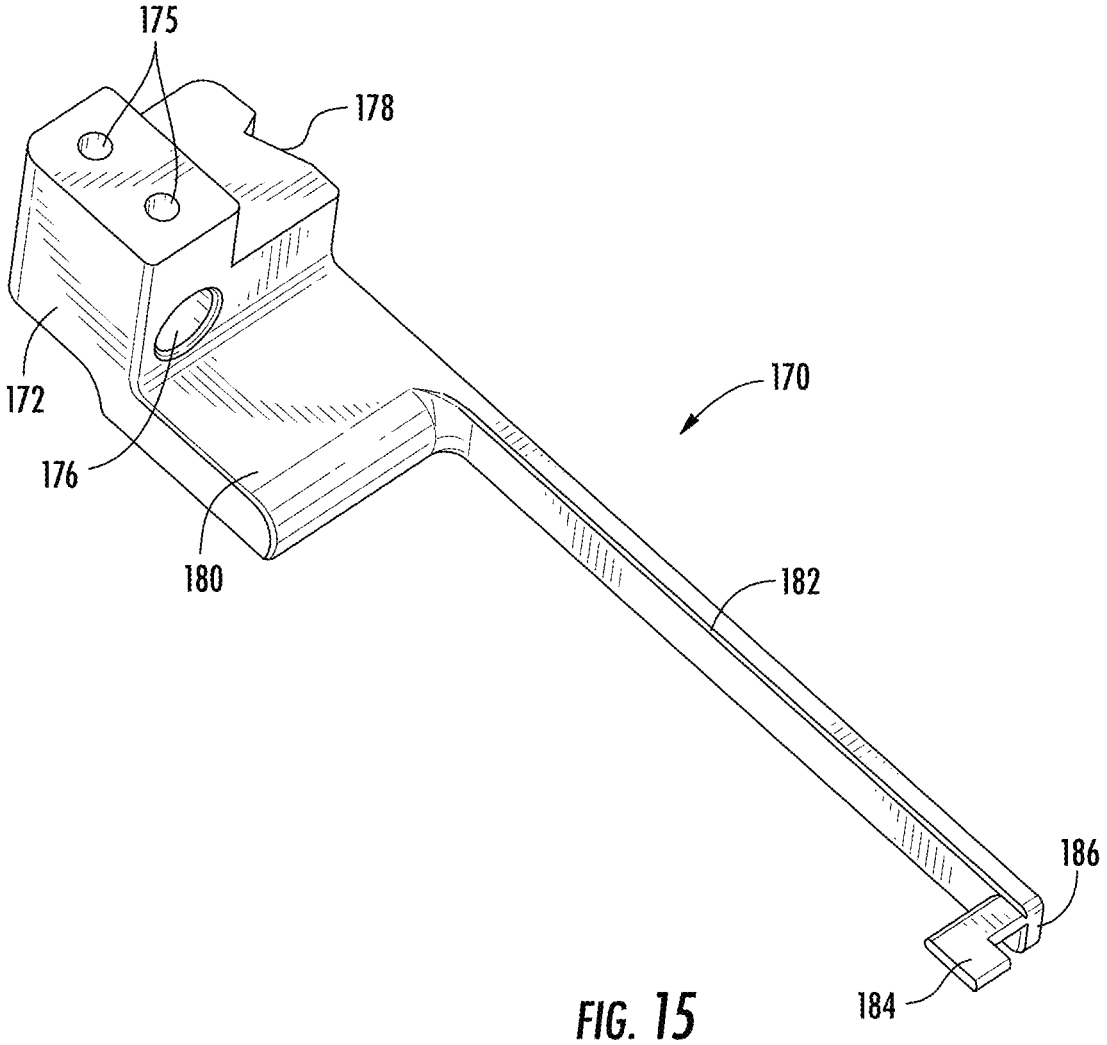
FIG. 15 is a right perspective view of a bypass block of the trigger assembly.
Figure 16:
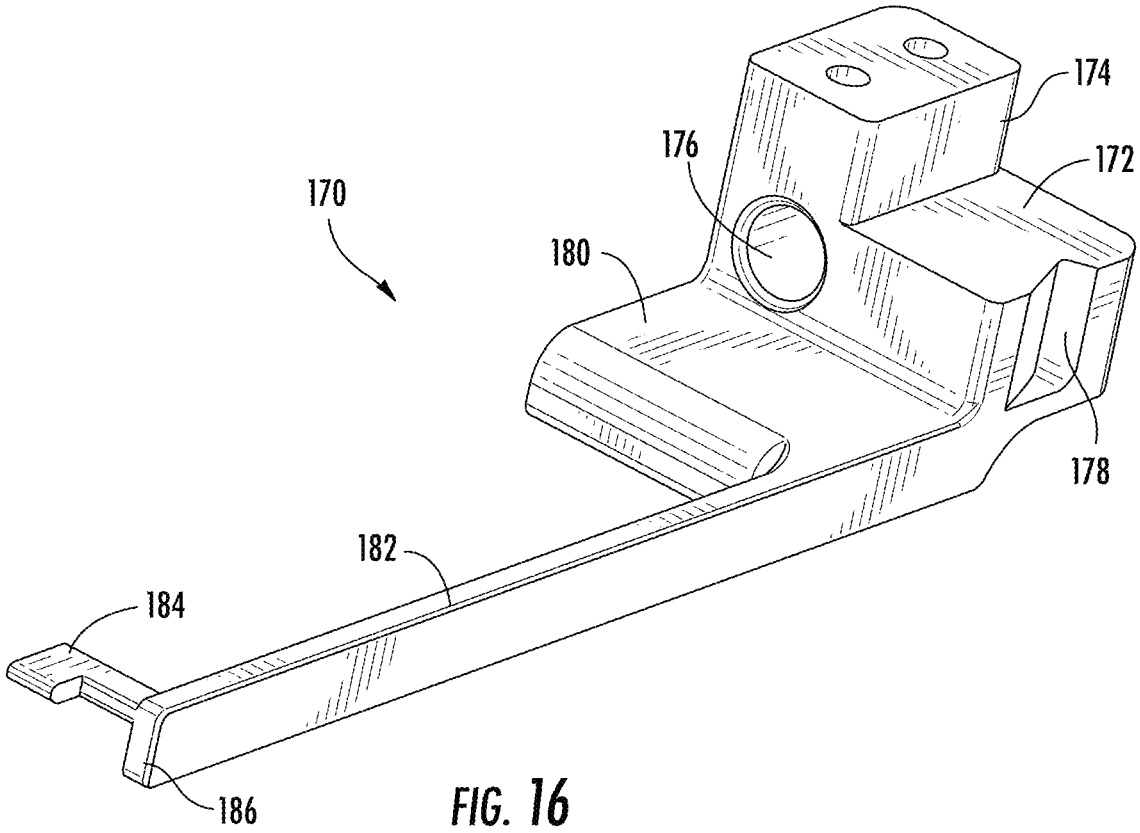
FIG. 16 is a left perspective view of the bypass block.

Referring now to FIGS. 15 and 16, trigger assembly 10 also includes bypass block 170. Bypass block 170 includes body portion 172 having shoulder 174 and apertures 175 in an upper surface. Spring opening 176 may be disposed in a forward end of body portion 172. Spring opening 176 is configured to receive and retain one end of a bypass block spring. Lockout notch 178 may be disposed in a side surface of body portion 172. Flat extension 180 may extend forward from body portion 172. Bypass arm 182 may extend forward from an outer end of flat extension 180. Bypass key 184 may extend inward from distal end 186 of bypass arm 182.

Figure 17:
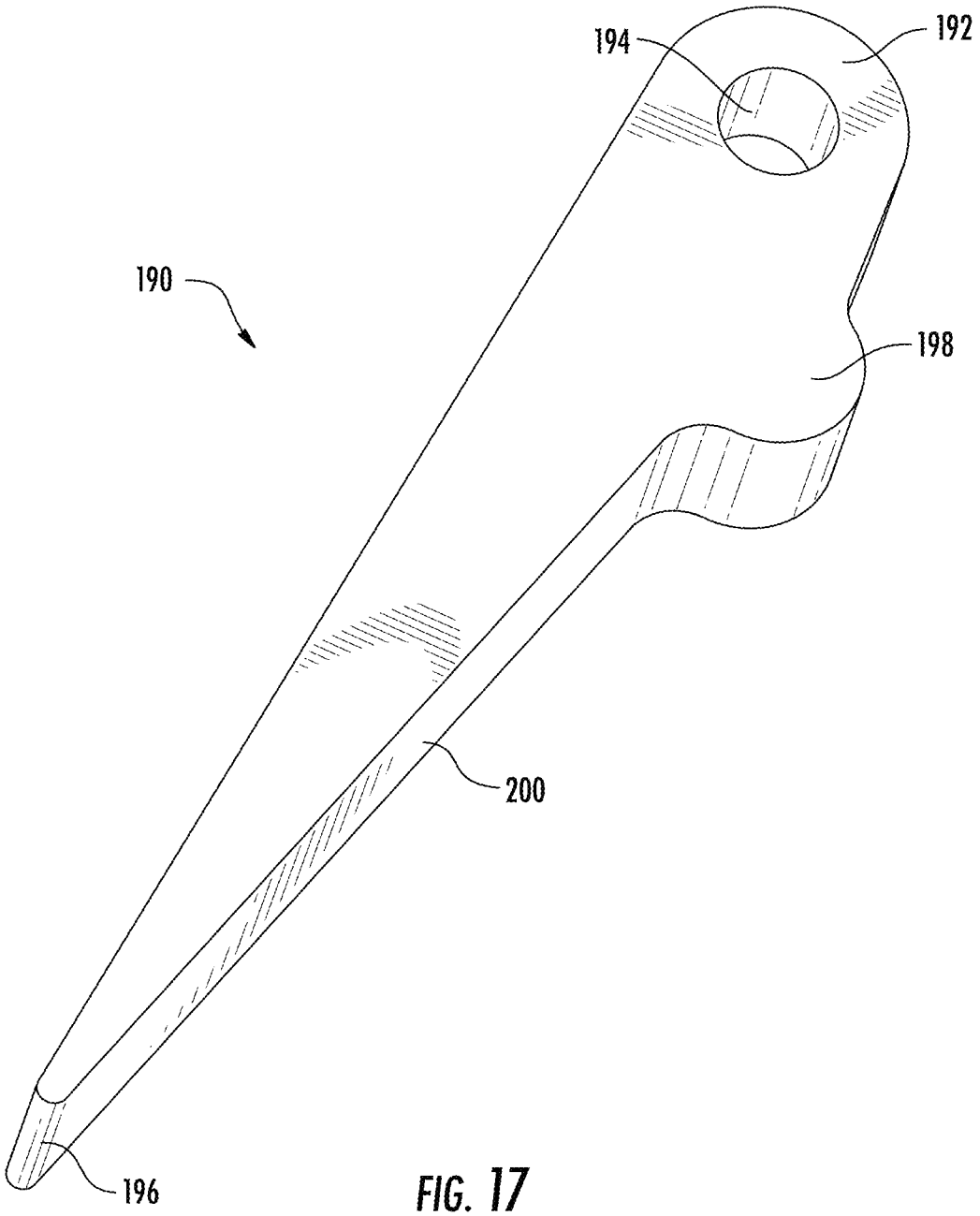
FIG. 17 is a top perspective view of a lockout pawl of the trigger assembly.
Figure 18:
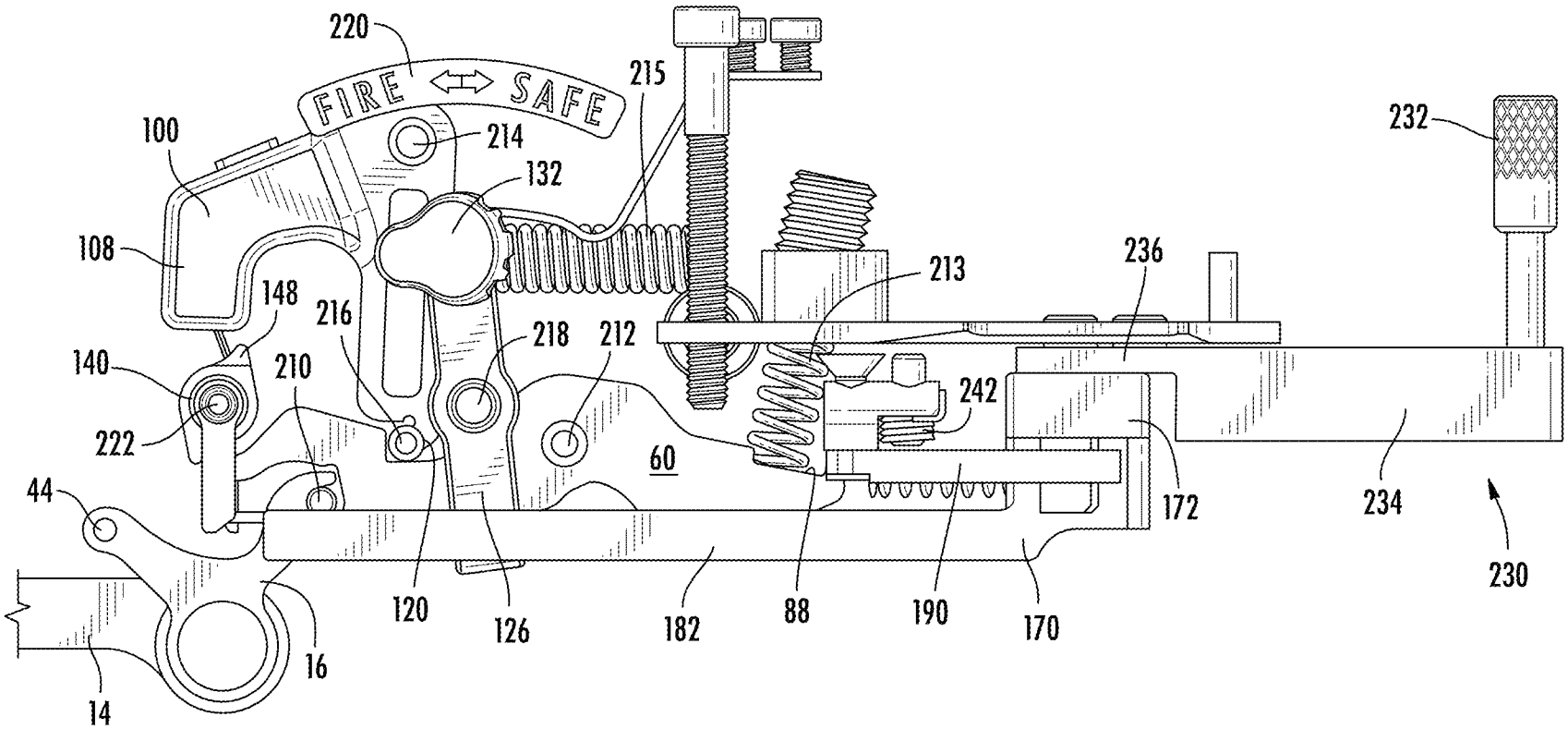
FIG. 18 is another side view of the trigger assembly.
Figure 19:
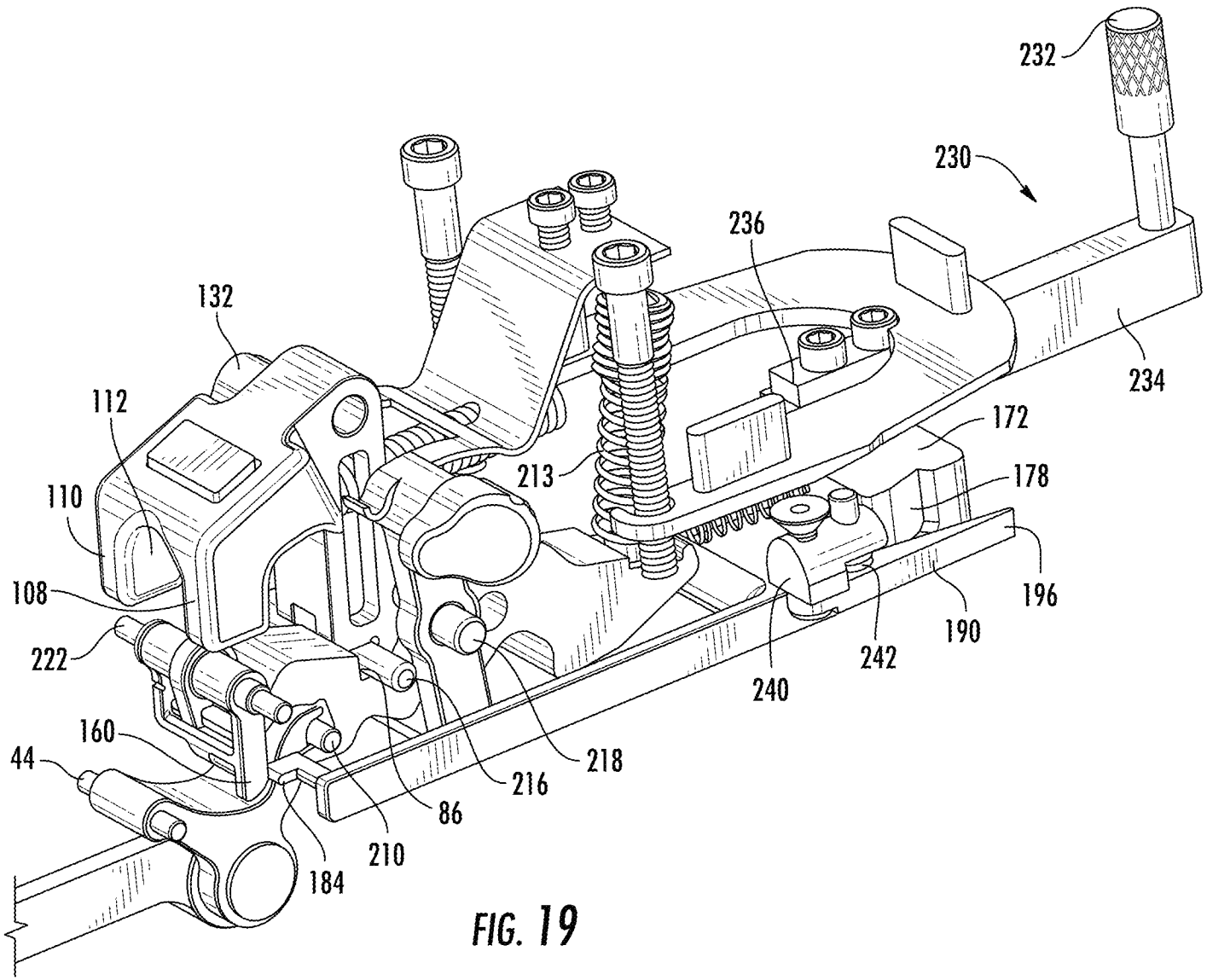
FIG. 19 is a front perspective view of the trigger assembly.
Figure 20:
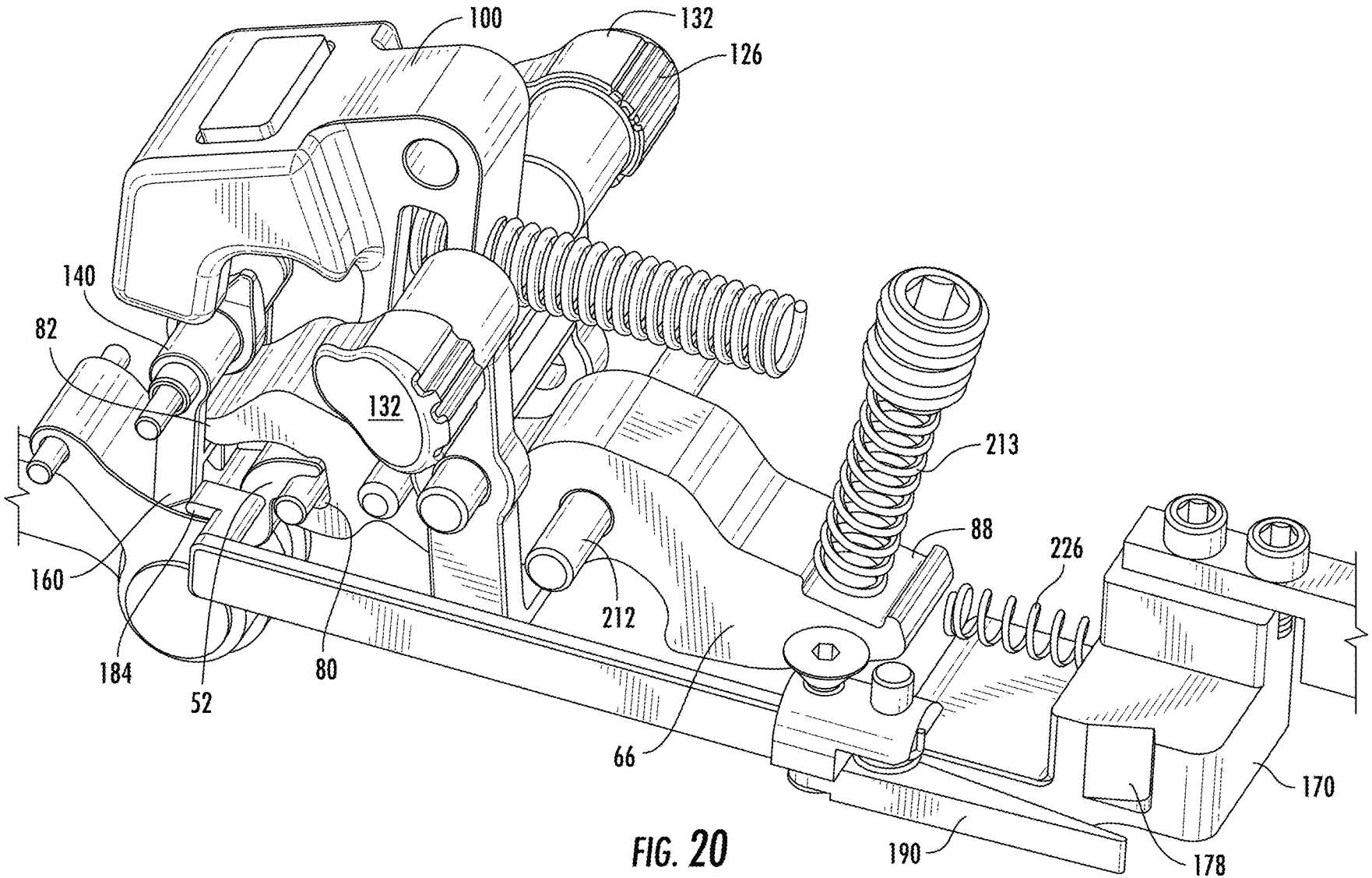
FIG. 20 is a left side perspective view of the trigger assembly.
Figure 21:
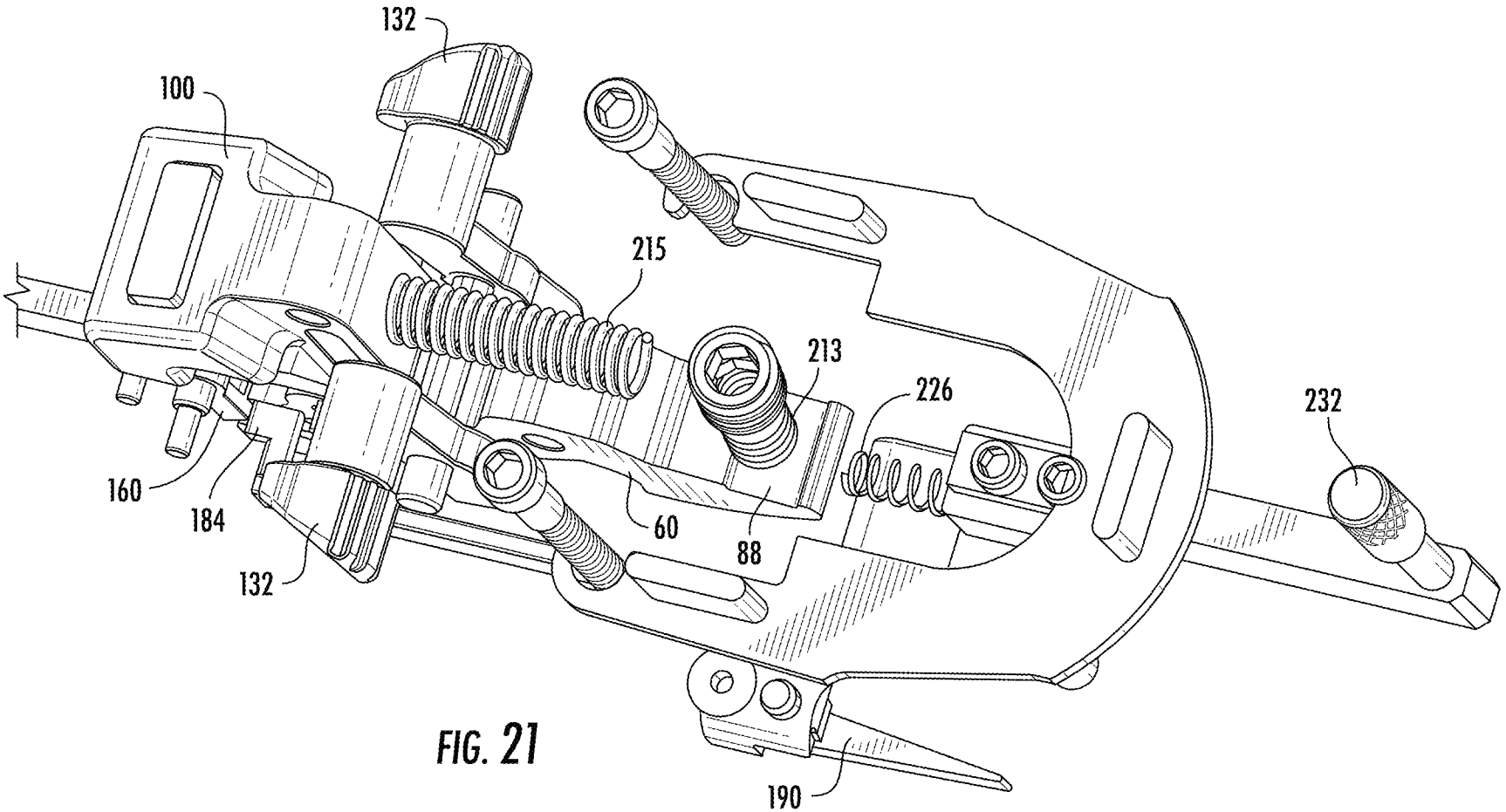
FIG. 21 is a top perspective view of the trigger assembly.
Figure 22:
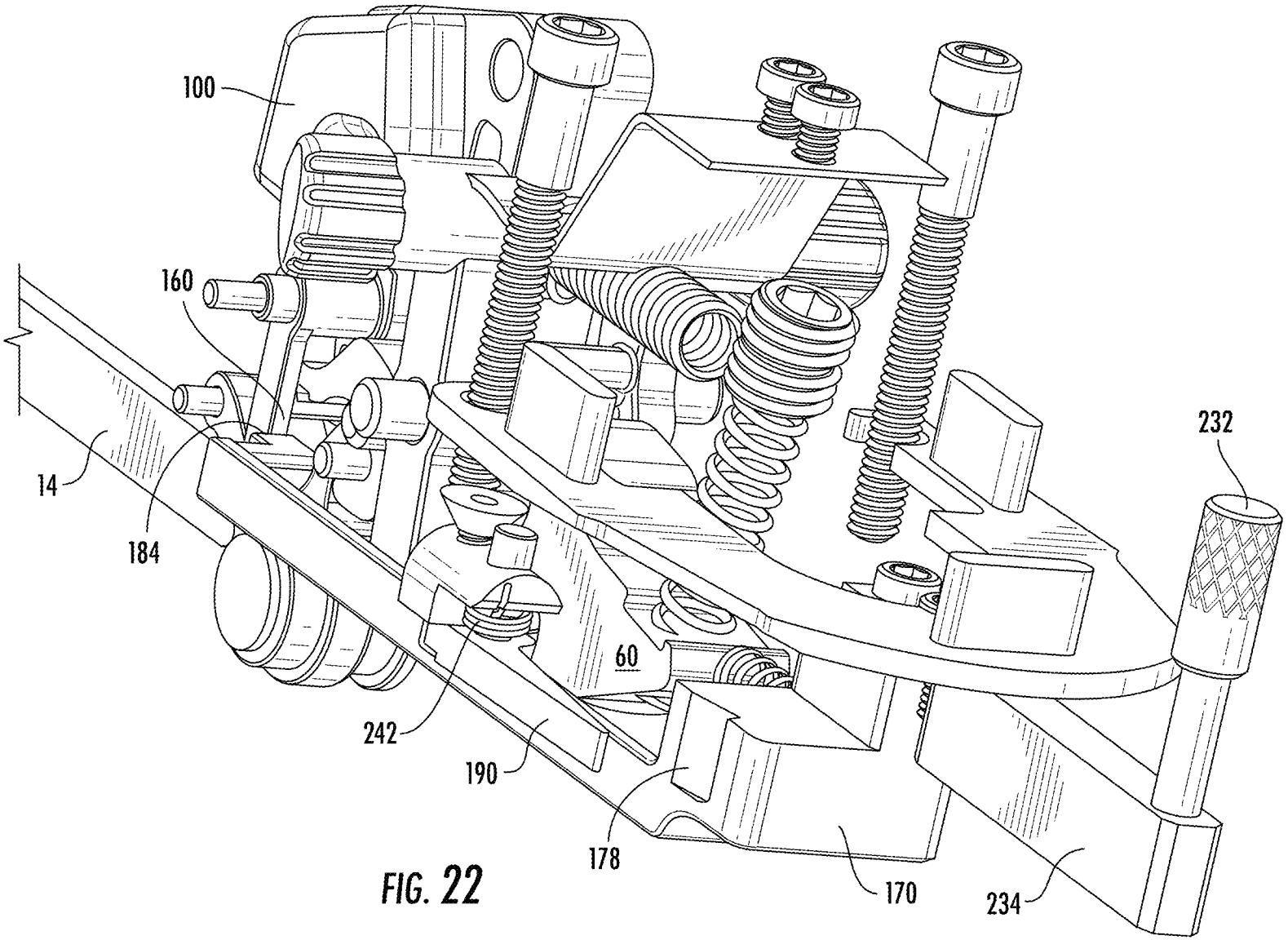
FIG. 22 is a rear perspective view of the trigger assembly.
Figure 23:
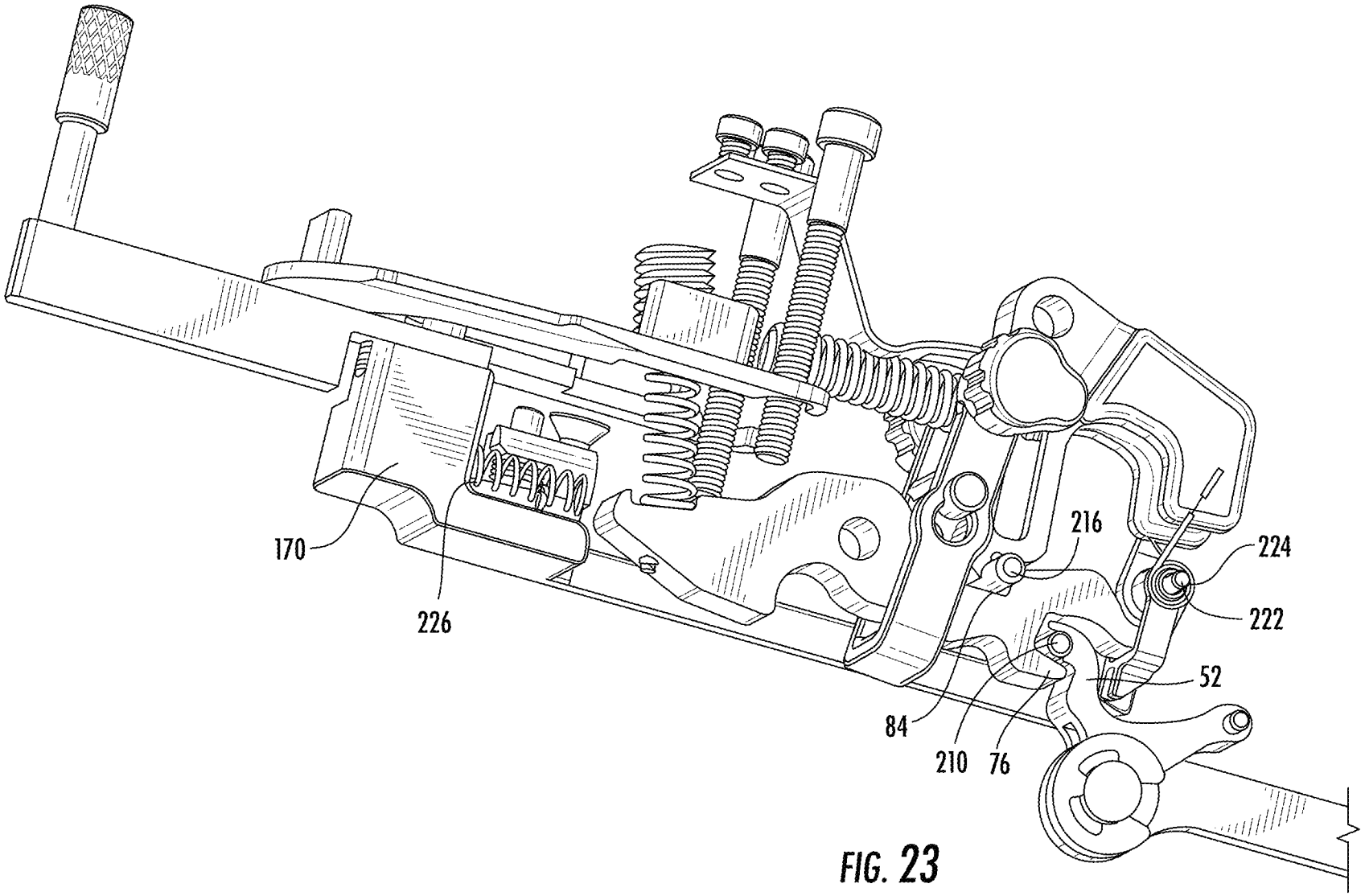
FIG. 23 is a right side perspective view of the trigger assembly.

With reference to FIG. 17, trigger assembly 10 may also include lockout pawl 190. Lockout pawl 190 extends from forward end 192 having pivot bore 194 to rearward end 196. Extension 198 is disposed near pivot bore 194. Tapered surface 200 extends from extension 198 to rearward end 196. Pivot bore 194 is configured to house a lockout pawl pivot pin. Each end of the lockout pawl pivot pin may be secured in an aperture or groove of a housing to secure lockout pawl 190 with the housing for rotation about the lockout pawl pivot pin.

Referring now to FIGS. 18-23, trigger assembly 10 includes trigger linkage 14 secured to trigger lever 12 (shown in FIGS. 1-4) such that when a user pulls the contact surface of trigger lever 12 rearward, trigger linkage 14 is pulled in a forward direction (to the left in FIG. 18) and pawl 16 is rotated in a first or clockwise direction about pawl pivot pin 44.

Rear portion 52 of pawl 16 is disposed in cavity 78 of sear 60. First trigger pin 210 is disposed below pin pocket 54 of pawl 16 and above upper surface 80 of lower forward portion 76 of sear 60. First trigger pin 210 is configured to freely rotate between pawl 16 and sear 60. First trigger pin 210 is also configured for vertical movement in response to relative movement between pawl 16 and sear 60. In one embodiment, both ends of first trigger pin 210 are secured within a vertical slot in an inner wall of the crossbow housing to provide for the vertical movement of first trigger pin 210. Sear pivot pin 212 is disposed through central pivot bore 62 of sear 60. Sear spring 213 is disposed above rearward portion 66 of sear 60. Specifically, the lower end of sear spring 213 engages upper spring surface 88 of sear 60. Sear spring 213 biases sear 60 in a first or clockwise direction about sear pivot pin 212. Sear spring 213 may be a compression spring. Sear spring may be configured for adjustment in its compression strength.

Catch 100 is disposed above forward portion 64 of sear 60. Catch pivot pin 214 is disposed in pivot bore 106 of catch 100. Catch spring 215 is disposed behind catch 100. Specifically, the forward end of catch spring 215 engages spring retainer 122 on rearward surface 124 of catch 100. Catch spring 215 biases catch 100 in a first or clockwise direction about catch pivot pin 214. Catch spring 215 may be a compression spring. A crossbow string may be retained by catch 100. Specifically, the crossbow string may be secured behind first and second hook portions 108 and 110. The crossbow string exerts a forward force on rear surfaces 114 and 116 of first and second hook portions 108 and 110, which, if unbalanced, would cause catch 100 to rotate in the first or clockwise direction about catch pivot pin 214.

Second trigger pin 216 is disposed below vertical portion 102 and in front of sear pin surface 120 of catch 100. Second trigger pin 216 rests on upper catch surface 84 of sear 60. Upper catch surface 84 of sear 60 supports second trigger pin 216 due to the biasing effect of sear spring 213. Sear pin surface 120 of catch 100 exerts a forward force on second trigger pin 216 due to the biasing effect of catch spring 215 on the lower end of vertical portion 102. This forward force causes second trigger pin 216 to engage catch shoulder 86 of sear 60. Second trigger pin 216 is configured to freely rotate between sear 60 and catch 100. Second trigger pin 216 is also configured for vertical movement in response to relative movement between sear 60 and catch 100. In one embodiment, both ends of second trigger pin 216 are secured within a vertical slot in an inner wall of the crossbow housing to provide for the vertical movement of second trigger pin 216.

Generally, when a user pulls trigger lever 12, trigger linkage 14 is pulled in a forward direction and pawl 16 rotates in a first or clockwise direction about pawl pivot pin 44. This rotation draws rear portion 52 of pawl 16 downward, which pushes first trigger pin 210 and lower forward portion 76 of sear 60 downward against the biasing effect of sear spring 213. As forward portion 64 of sear 60 pivots downward, second trigger pin 216 travels downward on upper catch surface 84. The forward force exerted by sear pin surface 120 of catch 100 on second trigger pin 216 may cause second trigger pin 216 to rotate as forward portion 64 of sear 60 rotates downward. When the lowest point on sear pin surface 120 of catch 100 passes the midpoint of the diameter of second trigger pin 216, catch spring 215 may cause sear pin surface 120 of catch 100 to roll over the top of second trigger pin 216, thereby allowing catch 100 to rotate in the first or clockwise direction. This rotation of catch 100 releases the crossbow string from first and second hook portions 108 and 110 of catch 100, thereby firing the crossbow. The remaining components of trigger assembly 10 interact with sear 60 to provide additional features.

Safety 126 is disposed around sear 60 with safety pivot pin 218 secured through pivot bores 130 of safety arms 128. More specifically, forward portion 64 of sear 60 may be disposed through a space between arms 128 of safety 126, base 131 of safety 126, and safety pivot pin 218. Trigger assembly 10 may further include label plate 220 indicating the position of safety 126 based on the position of knobs 132. Safety 126 may be placed in the safety position by sliding knobs 132 in a rearward direction, which transfers base 131 of safety 126 in a forward direction. In the safety position, base 131 of safety 126 may be disposed below first lower surface 70 of sear 60. In this position, base 131 of safety 126 prevents forward portion 64 of sear 60 from rotating downward, thereby preventing the crossbow from being fired. Safety 126 may be placed in the disabled position by sliding knobs 132 in a forward direction, which transfers base 131 of safety 126 in a rearward direction. In the disabled position, base 131 of safety 126 may be disposed below second lower surface 72 of sear 60. Alternatively, in the disabled position, base 131 of safety 126 may be disposed below central pivot bore 62 of sear 60. In both embodiments, base 131 of safety 126 does not limit the downward rotation of forward portion 64 of sear 60.

Nock sensor 140 is disposed below first and second hook portions 108 and 110 of catch 100, generally forward of sear 60, and above pawl 16. Nock sensor pivot pin 222 may be disposed through pivot bore 142 of nock sensor 140. Nock torsion spring 224 (shown in FIG. 23) may be positioned about nock sensor pivot pin 222 to bias nock sensor 140 toward a first or counterclockwise rotation. In a default position, nock sensor extension 82 of sear 60 may be disposed within the space created by axle portion 144, base 158, and arms 154 and 156 of nock sensor 140. In the default position, nock sensor extension 82 of sear 60 may engage lower peak 150 of nock sensor 140 to balance the biasing force of nock torsion spring 224 on nock sensor 140. In other words, nock torsion spring 224 biases lower peak 150 of nock sensor 140 against nock sensor extension 82 of sear 60. In this default position, base 158 of nock sensor 140 prevents forward portion 64 of sear 60 from rotating downward.

A nock of an arrow may be placed on a crossbow string held in catch 100 by inserting the nock in space 112 between first and second hook portions 108 and 110 of catch 100. When the nock is inserted into space 112, the nock places nock sensor 140 in an engaged position. Specifically, the nock engages upper peak 148 of nock sensor 140 and exerts a rearward force on upper peak 148, which in turn rotates nock sensor 140 in a second or clockwise direction about nock sensor pivot pin 222 against the biasing force of nock torsion spring 224. In the engaged position, nock sensor extension 82 of sear 60 is free from nock sensor 140. Accordingly, in the engaged position, nock sensor 140 does not prevent forward portion 64 of sear 60 from rotating downward to fire the crossbow. Nock torsion spring 224 maintains nock sensor 140 in the default position unless an arrow nock is present in space 112. In this way, nock sensor 140 acts as a safety to prevent dry firing of the crossbow.

Bypass block 170 is disposed around sear 60 with bypass key 184 engaging a rear surface of outer extension 160 of nock sensor 140. Bypass spring 226 biases bypass block 170 in a rearward direction. Specifically, an end of bypass spring 226 engages spring opening 176 of bypass block 170. Bypass spring 226 may be a compression spring. Release switch 230 is disposed generally behind bypass block 170. Release switch 230 includes switch control 232 configured for contact by a user. Switch control 232 is secured to switch base 234, which extends to connection plate 236. Connection plate 236 is secured to an upper surface of body portion 172 of bypass block 170. Connection plate 236 of release switch 230 may be secured to body portion 172 of bypass block 170 by securing a fastening mechanism (e.g., a bolt or screw) through openings in connection plate 236 and through apertures 175 in the upper surface of body portion 172 of bypass block 170. In this way, release switch 230 is secured to bypass block 170 for transferring forward or rearward movement of release switch 230 to bypass block 170. Pushing switch control 232 forward pushes bypass block 170 and its bypass key 184 forward, which engages outer extension 160 of nock sensor 140 to rotate nock sensor 140 in a second or clockwise direction into the engaged position of the nock sensor 140. With nock sensor 140 in the engaged position (and safety in the released position), forward portion 64 of sear 60 is not prevented from rotating downward. In this way, bypass block 170 provides a mechanism for releasing a crossbow string from catch 100 without the presence of a nock in space 112. In other words, release switch 230 and bypass block 170 bypass nock sensor 140 to decock the crossbow.

Lockout pawl 190 is secured to adapter 240, which is configured for connection to a crossbow track. Lockout pawl 190 is configured for rotation relative to adapter 240. Lockout torsion spring 242 biases lockout pawl 190 inward toward a default position in which rearward end 196 of lockout pawl 190 is disposed in lockout notch 178 of bypass block 170, thereby preventing any forward movement of bypass block 170. In this way, lockout pawl 190 prevents the forward movement of release switch 230 and bypass block 170. In the default position of lockout pawl 190, a user is not able to activate release switch 230 to release a crossbow string from catch 100 without the presence of a nock engaging nock sensor 140.

Figure 24:
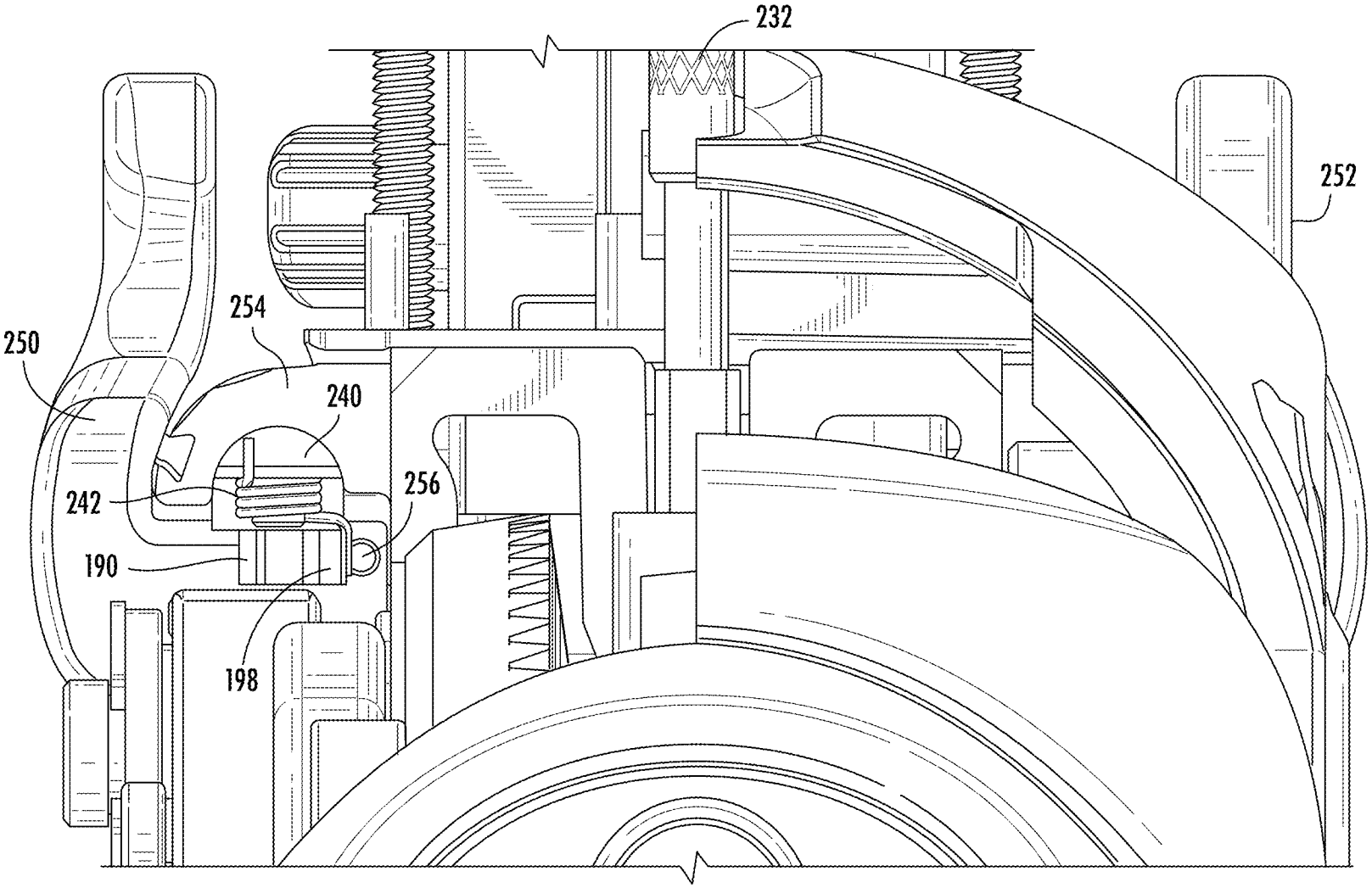
FIG. 24 is a rear cut-away view of the lockout pawl secured to a crossbow track.

With reference to FIG. 24, the crossbow may include hook members 250 and 252 partially disposed within crossbow track 254 for sliding along a length of crossbow track 254. Each hook member 250 and 252 may include hook pin 256 extending from its rearward end. As hook members 250 and 252 slide within track 254, hook pin 256 may engage extension 198 of lockout pawl 190 such that hook pin 256 rotates lockout pawl 190 to transfer rearward end 196 in an outward direction (to the position shown in FIG. 24). In this way, the hook members disengage lockout pawl 190 from bypass block 170 to enable a user to slide release switch 230 forward and to release the crossbow string from catch 100 without a nock engaging nock sensor 140, but only when the hook members are properly positioned to receive the crossbow string near its cocked position (i.e., when the hook members are adjacent to catch 100). Once the user activates release switch 230 to bypass nock sensor 140, the user may pull trigger lever 12 in the rearward direction to release the crossbow string from catch 100.

Figure 25:
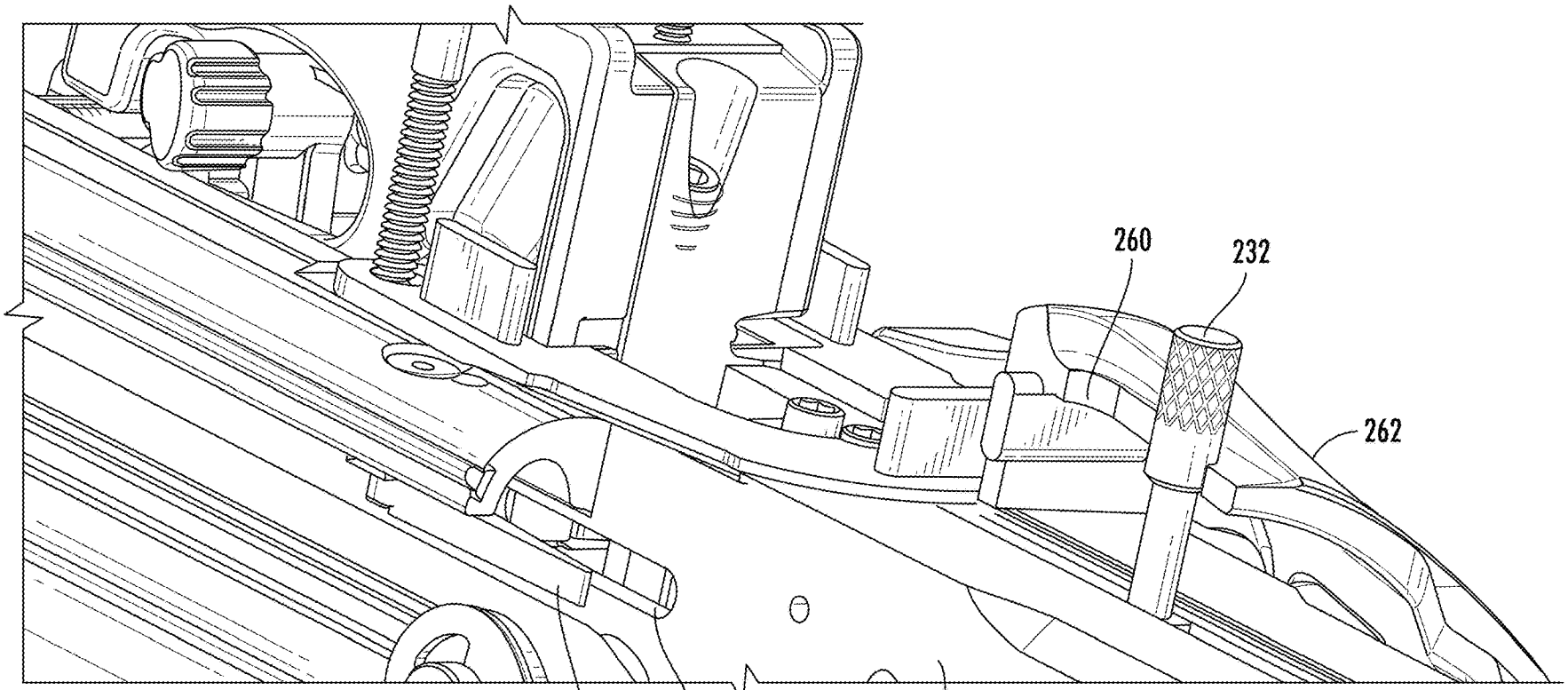
FIG. 25 is a perspective view of the lockout pawl and a release switch of the trigger assembly.

FIG. 25 illustrates switch control 232 of release switch 230 extending through opening 260 of housing 262 of a crossbow. Crossbow track 254 includes elongated opening 264 configured to allow lockout pawl 190 to extend therethrough for engaging lockout notch 178 on bypass block 170.

Figure 26:
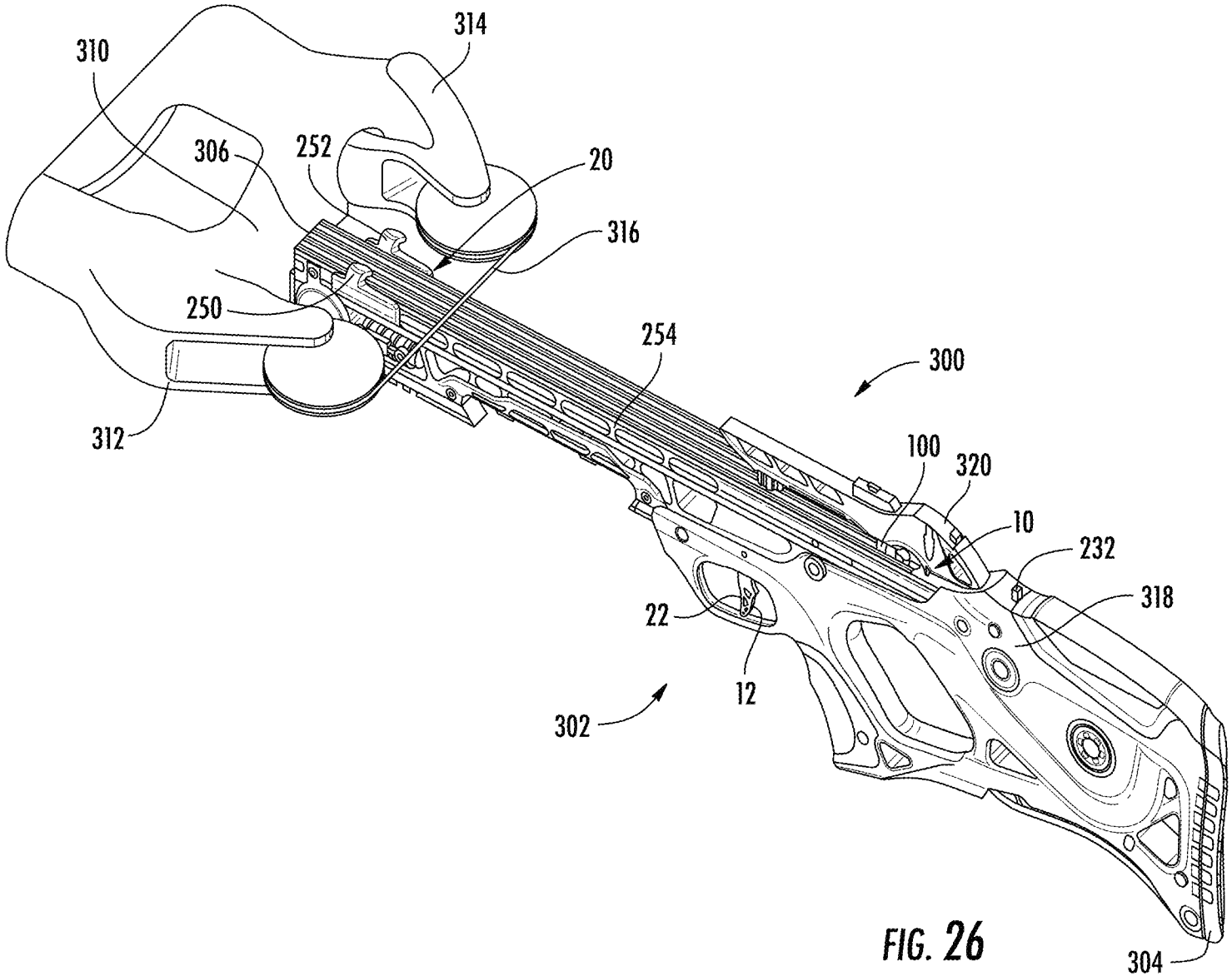
FIG. 26 is a perspective view of a crossbow including the trigger assembly.
Figure 27:
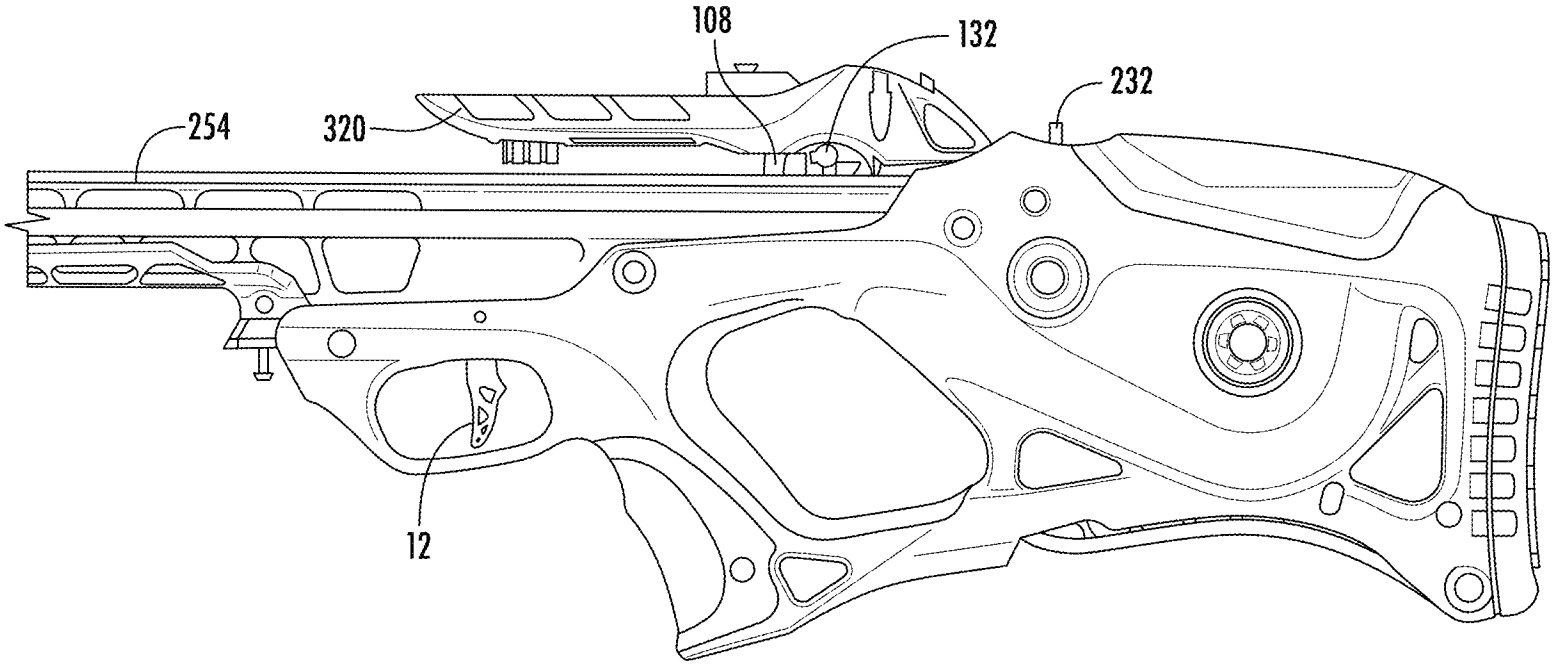
FIG. 27 is a partial side view of the crossbow shown in FIG. 26.

FIGS. 26 and 27 illustrate crossbow 300 including crossbow stock 302 extending from butt end 304 to forward end 306. Crossbow 300 also includes riser 310 secured to forward end 306 of crossbow stock 302. Bow limbs 312 and 314 are each secured to riser 310. Crossbow string 316 extends from a distal end of bow limb 312 above an upper surface of crossbow track 254 to a distal end of bow limb 314. Crossbow 300 includes trigger assembly 10. Trigger lever 12 is disposed below crossbow track 254. Switch control 232 of release switch 230 extends above crossbow housing 318. Knobs 132 of safety 126 and hook portions 108 and 110 of catch 100 are disposed between crossbow hood 320 and crossbow track 254.

A user may place crossbow string 316 in a cocked position by securing crossbow string 316 behind hook portions 108 and 110 of catch 100. The user may place safety 126 in the safety position such that trigger lever 12 may not be pulled to release crossbow string 316. Even without the safety 126 in the safety position, nock sensor 140 prevents trigger lever 12 from being capable of releasing crossbow string 316 without an arrow's nock engaging nock sensor 140.

The user may position an arrow on crossbow track 254 with the arrow's nock disposed in space 112 of catch 100 such that the nock sensor 140 is placed in the engaged position. The user may also place safety 126 in the disabled position. Pulling trigger lever 12 rearward with nock sensor 140 in the engaged position and safety 126 in the disable position will release crossbow string 316 from catch 100.

If, before firing the crossbow, the user desires to transfer crossbow string 316 from the cocked position (in which crossbow string 316 is retained by catch 100) to the uncocked position (illustrated in FIG. 26) without firing an arrow, the user may slide hooks 250 and 252 rearward along crossbow track 254 until hook pin 256 engages extension 198 of lockout pawl 190 to disengage lockout pawl 190 from notch 178 of bypass block 170. With the hooks 250 and 252 in this position near catch 100, the user may slide switch control 232 forward within the opening in the crossbow housing, thereby transferring bypass block 170 forward to place nock sensor 140 in the engaged position. The user may then pull trigger lever 12 in a rearward direction to release crossbow string 316 from catch 100 into hooks 250 and 252, which may be used to move crossbow string 316 to the uncocked position in a controlled manner.

Figure 28:
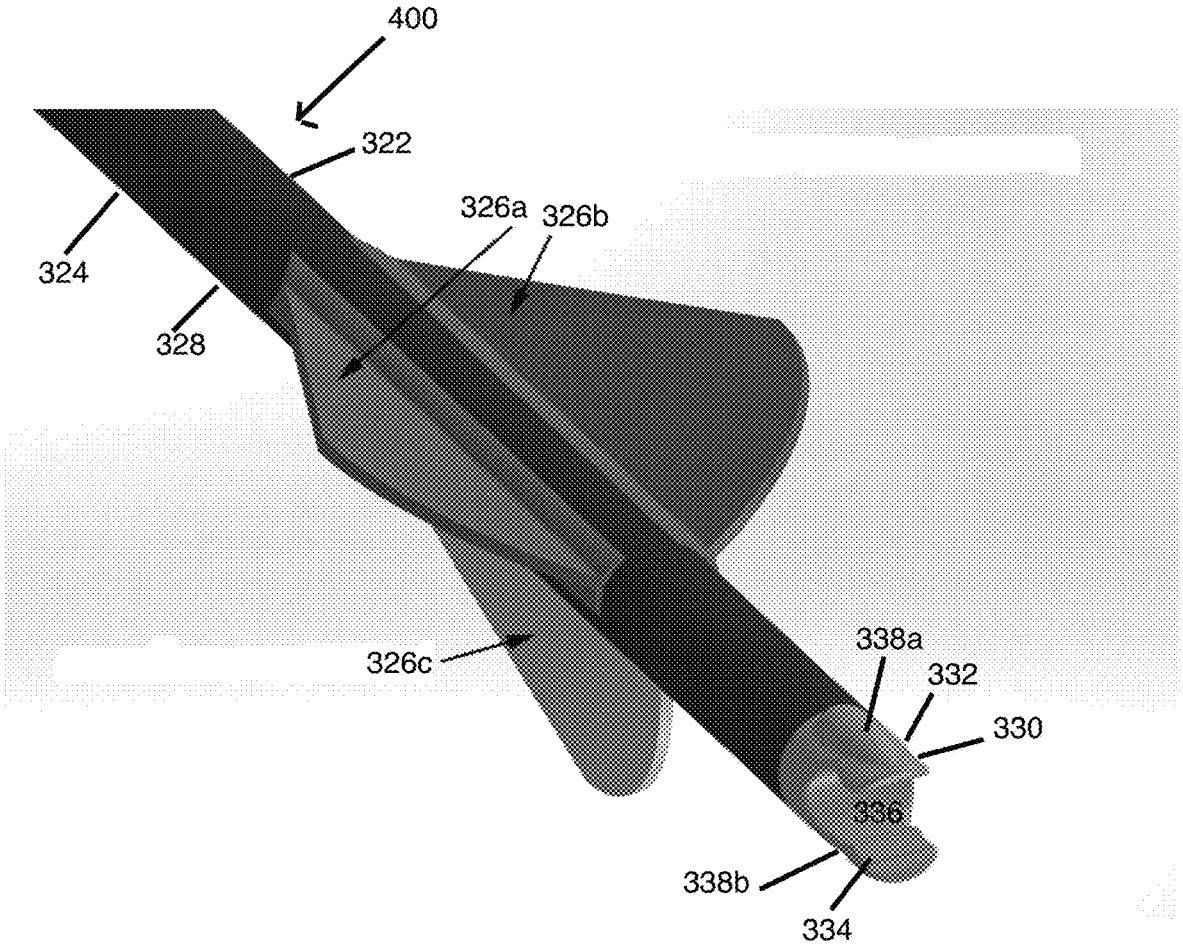
FIG. 28 is a perspective view of the end section of an arrow shaft with fletches attached to the outer surface of the shaft and nock partially inserted in the end of the shaft.

FIG. 28 partially depicts arrow 400. Arrow 400 includes end section 322 of arrow shaft 324. Three fletches or vanes 326*a*, 326*b*, and 326*c* extend outwardly from outer surface 328 of end section 322. Nock 330 is operatively positioned in the end of arrow shaft 324. Nock 330 contains arms 332 and 334 extending from the end of arrow shaft 324. Arms 332 and 334 are spaced apart by gap 336, which is dimensioned to receive bowstring 316. Arms 332 and 334 each contain extended portion 338*a* and 338*b* that increase the width of nock 330. As described below in more detail, nock 330 can only pass through space 112 between first and second hook portions 108, 110 of catch 100 and thus trip nock sensor 140 to permit firing of the crossbow when arrow 400 is oriented so that extended portions 338*a*, 338*b* of arms 332, 334 are vertically aligned in relation to a crossbow track (not shown) and fletch 326*c* is positioned within a central channel within the crossbow track. To assist in the proper orientation of arrow 400, fletch 326*c* may be marked in order to distinguish it from fletches 326*a* and 326*b*. For example, fletch 326*c* may have a different color than the color of fletches 326*a* and 326*b*.

Figure 29:
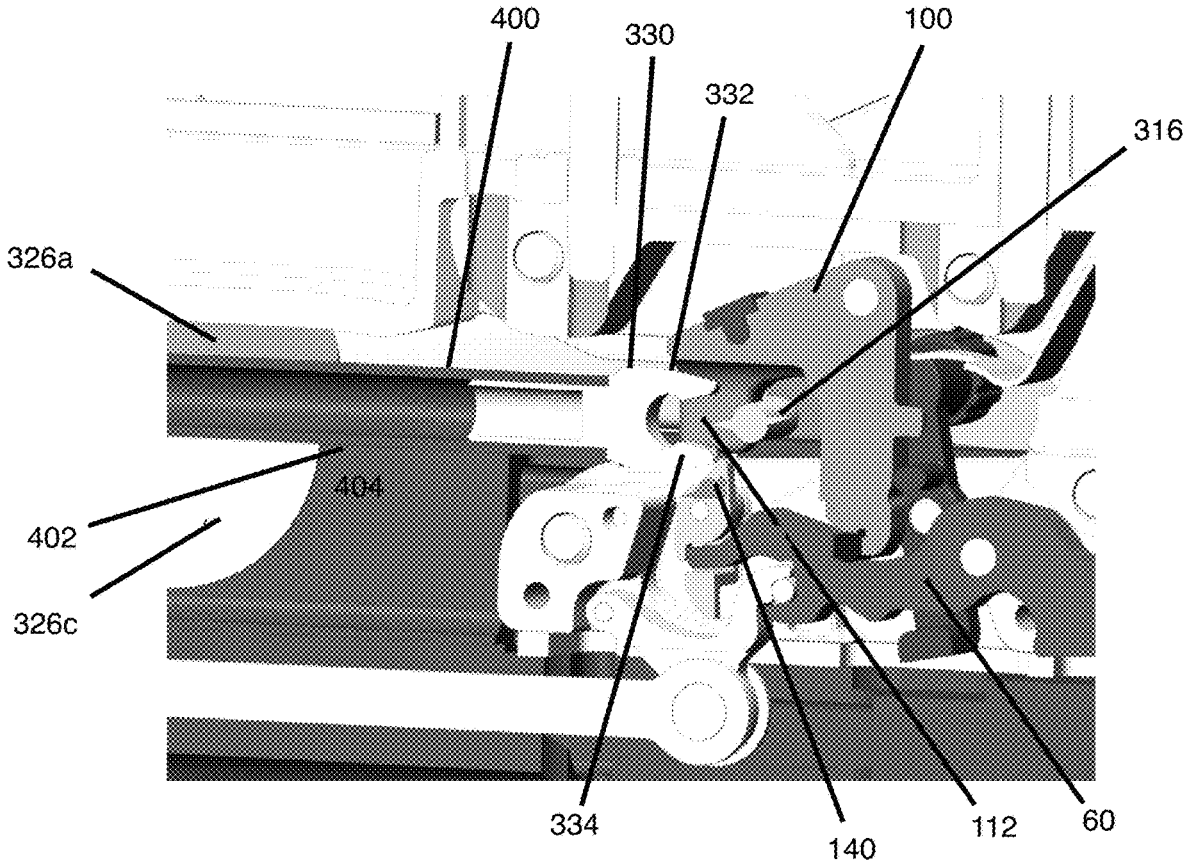
FIG. 29 is a cross-sectional view the trigger assembly with the nock being positioned through the fingers of the catch.

FIG. 29 illustrates arrow 400 positioned on crossbow track 402. Fletch 326*c* is properly positioned central channel 404 of track 402. Arms 332, 334 of nock 330 are also properly oriented in vertical alignment and thus nock 330 is able to pass through space 112 between first and second hook portions 108, 110.

Figure 30:
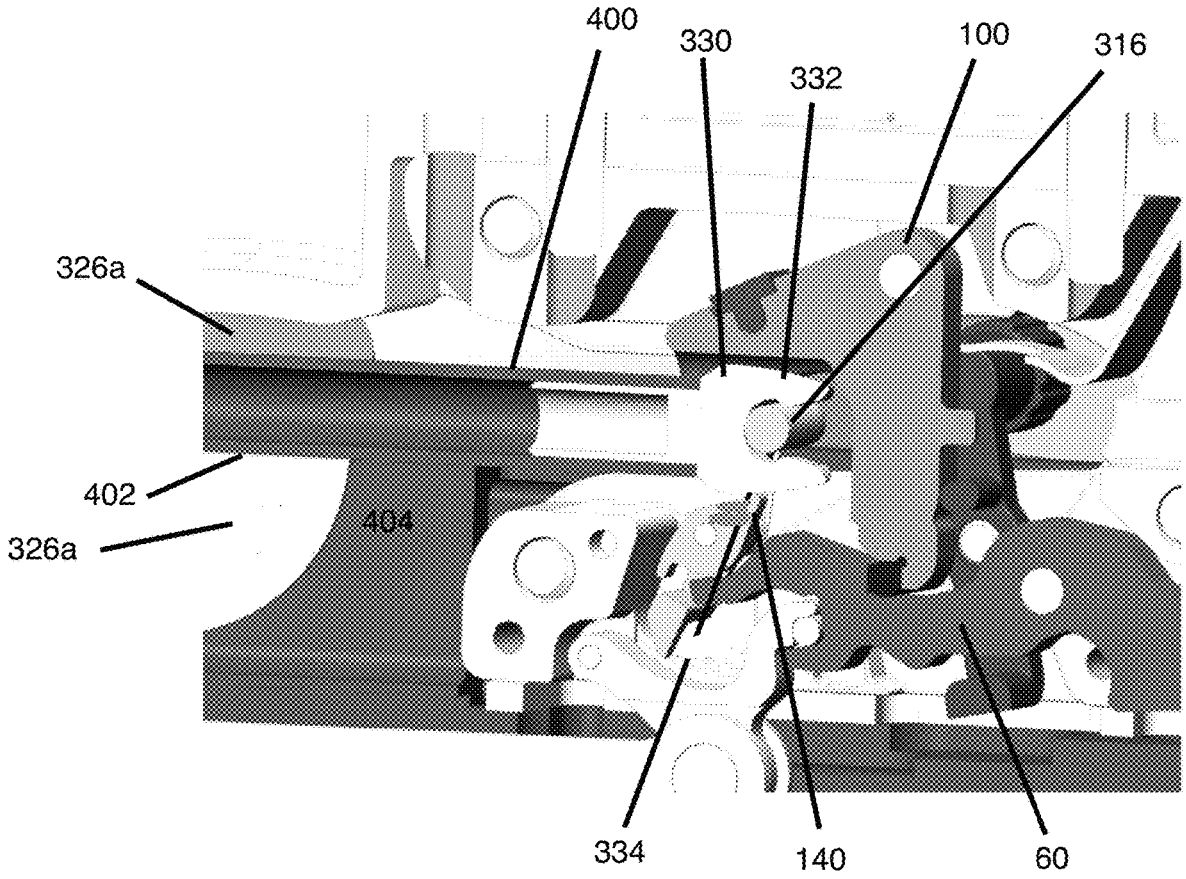
FIG. 30 is a cross-sectional view of the trigger assembly with the nock positioned about the bowstring with the nock sensor being actuated to enable firing of the crossbow.

In FIG. 30, nock 330 has passed through space 112 and is positioned on bowstring 316. Bowstring 316 extends within gap 336 of nock 330, which is the firing position of arrow 400 in relation to bowstring 316. Nock 330 has contacted nock sensor 140 actuating it to release and permit movement of sear 60 through activation of trigger lever 12 as described hereinabove to catch 100 to fire arrow 400 when bowstring 316 returns to its uncocked position.

Figure 31:
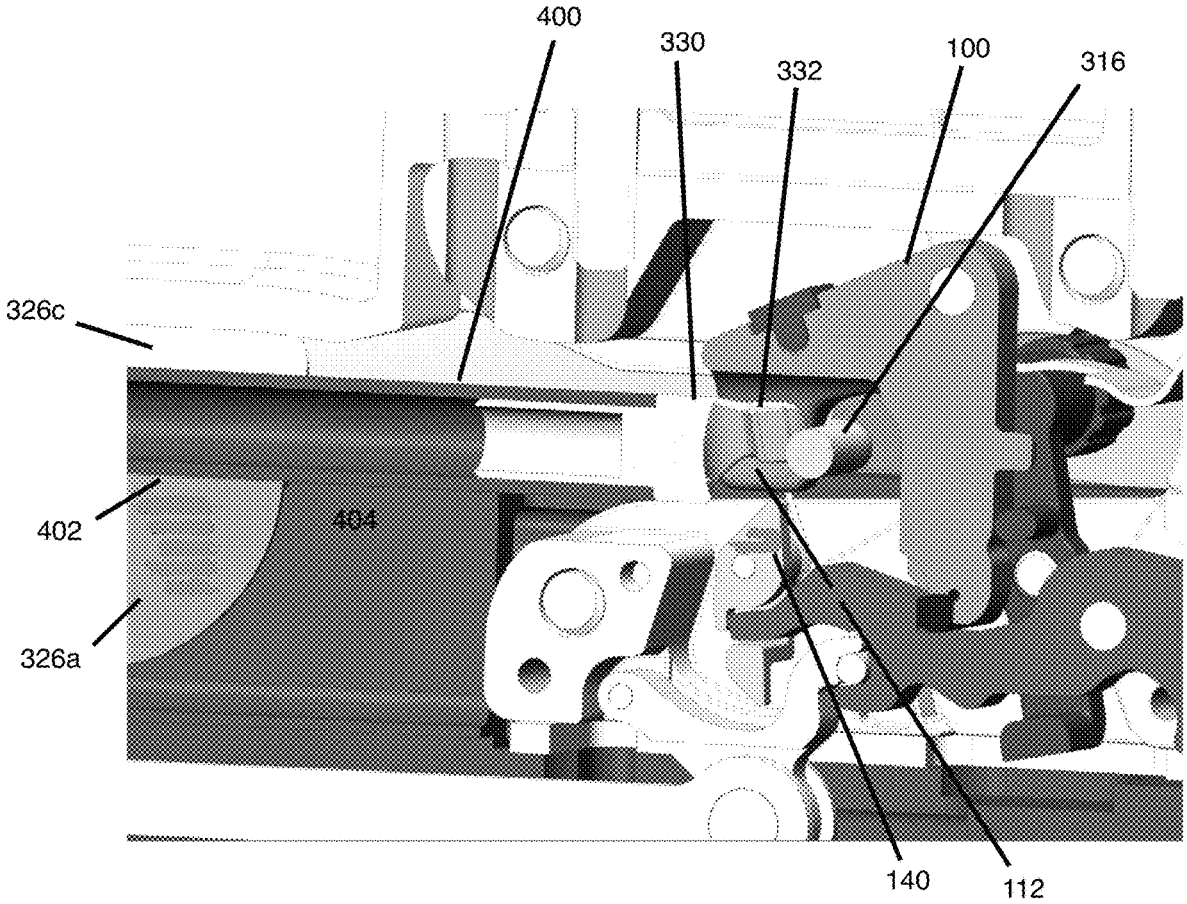
FIG. 31 is a cross-sectional view of the trigger assembly with the nock unable to be positioned about the bowstring with the nock sensor preventing firing of the crossbow.

FIG. 31 depicts arrow 400 placed in an improper orientation. Fletch 326*a* (or 326*b*) is positioned within channel 404 of crossbow track 402. Accordingly, arms 332, 334 of nock 330 are not vertically aligned and therefore cannot pass through space 112 in catch 100. Space 112 is only dimensioned to permit nock 330 to pass through catch 110 when arms 332, 334 are in vertical alignment and fletch 326*a* is positioned within channel 404 of crossbow track 402. Space 112 is dimensioned so as to not permit nock 330 to pass there-through when arms 332, 334 of nock 330 are not vertically aligned and fletch 326*a* is not positioned within channel 404 of crossbow track 402, as for example, when fletch 326*a* (or 326*b*) is positioned within channel 404.

Each assembly described herein may include any combination of the described components, features, and/or functions of each of the individual assembly embodiments. Each method described herein may include any combination of the described steps in any order, including the absence of certain described steps and combinations of steps used in separate embodiments. Any range of numeric values disclosed herein shall be construed to include any subrange therein.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof

What is claimed is:

1. A crossbow trigger system, comprising:

a nock sensor including an axle portion with a nock pivot bore for pivotal movement of the nock sensor about a nock sensor pivot pin accommodated within the nock pivot bore, a wheel portion fixedly disposed around a center section of the axle portion, the wheel portion including an upper peak section and a lower peak section, the axle portion including opposing outer ends, each end of the axle portion contains an arm extending from an underside of the axle portion to a base support that traverses the arms, one of the arms including an outer extension member, the base support having a top and a bottom, the base support including a central extension member extending from the bottom of the base support, the nock sensor pivot pin being operatively associated with a nock spring that biases the nock sensor in a first pivoting direction, the upper peak section of the wheel portion being operatively positioned within a gap between two hook portions of a catch that retain a bowstring in a firing position, the upper peak section of the wheel portion configured to receive a nock affixed to a rearward end of an arrow; wherein when the nock sensor has not received the nock, the nock sensor prevents actuation of the catch to release the bowstring for firing, and wherein when the nock sensor has received the nock, the nock sensor enables actuation of the catch to release the bowstring for firing; and a dry fire prevention assembly comprising a bypass block, a release switch, and a lockout pawl, the bypass block comprising a body portion having a top, a front, a rear, and outer and inner sides interconnecting the top and bottom, the outer side containing a lockout notch, a bypass arm longitudinally extending from the front and terminating at a distal end, the distal end containing a bypass key configured to operatively contact the nock sensor, the front being configured to receive an end of a bypass block spring that biases the bypass block in a rearward direction, the release switch comprising a switch base having a forward end and a rearward end, the forward end including a connection plate configured for operative connection to the bypass block, the rearward end containing a switch control for selective reciprocation of the bypass block in forward and rearward directions, wherein selective reciprocation of the bypass block in the forward direction causes the nock sensor to pivot in a second direction to disengage the base support of the nock sensor from a sear operatively associated with the catch to enable actuation of the catch to release the bowstring for firing, the lockout pawl having a forward end, a rearward end, a top, a bottom, and outer and inner sides interconnecting the top and bottom, the forward end of the lockout pawl containing a lockout pawl pivot bore extending through the top and bottom for pivotal movement of the lockout pawl about a lockout pawl pivot pin accommodated within the lockout pawl pivot bore, the inner side of the lockout pawl including an extension portion and a tapered surface terminating at the rearward end, a lockout spring biases the lockout pawl inwardly so that when the switch control has selectively reciprocated the bypass block in the rearward direction, the rearward end of the lockout pawl is disposed in the lockout notch of the bypass block preventing reciprocation of the bypass block in the forward direction.

2. The crossbow trigger system of claim 1, wherein the upper peak section of the nock sensor contains a concave forward surface.

3. The crossbow trigger system of claim 2, wherein the outer extension member of the nock sensor contains a tapered rear surface.

4. The crossbow trigger system of claim 3, wherein the central extension member of the nock sensor contains a tapered forward surface.

5. The crossbow trigger system of claim 1, further comprising an adapter operatively secured to the lockout pawl, the adapter being configured for connection to a crossbow track, the crossbow track configured for sliding movement of a hook assembly, the hook assembly including a hook pin, wherein the hook pin contacts the extension portion of the lockout pawl when the hook assembly is slidably positioned on the crossbow track adjacent to the catch and disengages the rearward end of the lockout pawl from the lockout notch of the bypass block to enable the switch control of the release switch to selectively reciprocate the bypass block in the forward direction.

6. The crossbow trigger system of claim 1, wherein the connection plate of the release switch is operatively connected to the top of the bypass block.

7. The crossbow trigger system of claim 1, wherein the bypass key extends inwardly from the distal end of the bypass arm and operatively contacts a rear surface of the outer extension of the nock sensor.

8. The crossbow trigger system of claim 1, wherein the gap between the hook portions of the catch is dimensioned to prevent accommodation of the nock unless the nock is oriented in a select position.

9. The crossbow trigger system of claim 8, wherein the nock includes two opposing arms each containing an extended portion, and wherein the select position of the nock comprises the arms of the nock being vertically aligned.

10. The crossbow trigger system of claim 9, wherein the nock is operatively fixed to an end of an arrow shaft, the arrow shaft including a plurality of fletches, and wherein one of the fletches is marked as an alignment fletch, the alignment fletch being positioned within a channel of a crossbow track to achieve the select position of the nock.

11. A crossbow trigger system, comprising:

a trigger assembly including a trigger lever and a trigger linkage, the trigger lever having an upper end and a lower end, the lower end including a contact surface configured for placement of a user's trigger finger, the trigger linkage having a first end and a second end, the first end of the trigger linkage operatively connected to the upper end of the trigger lever, the trigger lever including a trigger lever pivot opening for pivotal movement of the trigger lever about a trigger pivot pin accommodated within the trigger lever pivot opening;

a pawl including a central body portion having an upper section and a lower section, two eye sections extending from the lower section of the central body portion and spaced apart by a gap, each eye section containing an eye bore, a pivot arm portion extending from a front of the upper section and a rear arm portion extending from a rear of the upper section, the pivot arm portion including a pawl pivot bore for pivotal movement of the pawl about a pawl pivot pin accommodated within the pawl pivot bore, the rear arm portion including a pin pocket surface, wherein the second end of the trigger linkage is operatively positioned in the gap between the two eye sections of the pawl and operatively connected to the pawl by a pawl linkage pin;

a sear including a forward portion, a central portion, and a rearward portion, the rearward portion having an upper spring surface interposed between a forward shoulder and a rearward shoulder, the upper spring surface configured to receive an end of a spring that biases the rearward portion downwardly to enable a pivoting of the sear in a first direction, the upper surface of the rearward portion including a forward shoulder spaced apart from the rearward shoulder, the central portion including a central pivot bore for pivotal movement of the sear about a sear pivot pin accommodated within the central pivot bore, the forward portion of the sear including an upper catch surface terminating at a catch shoulder and a lower surface comprising first and second lower surface sections separated by a safety ridge section, the forward portion including an upper forward portion arm and a lower forward portion arm separated by a cavity, the upper forward portion arm extending beyond the lower forward portion arm and terminating at a nock sensor extension section, the lower forward portion arm including an upper surface partially defining the cavity, the upper surface of the lower forward portion arm configured to cooperate with the pin pocket surface of the pawl;

a catch including a vertical portion and a canopy portion, the vertical portion having an upper end section, a lower end section, a forward surface section and a rearward surface section, the upper end section containing a catch pivot bore for pivotal movement of the catch about a catch pivot pin accommodated within the catch pivot bore, the lower end section including a sear pin surface operatively associated with the upper catch surface and catch shoulder of the sear and selectively displaceable therefrom, the canopy portion including two hook portions extending downwardly from the canopy portion and spaced apart by a gap, each of the hook portions including a rear surface for selective retention of a bowstring in a cocked or firing position, the rearward surface section configured to receive an end of a catch spring that biases the catch to enable a pivoting of the catch in a first direction;

a nock sensor including an axle portion with a nock pivot bore for pivotal movement of the nock sensor about a nock sensor pivot pin accommodated with the nock pivot bore, a wheel portion fixedly disposed around a center section of the axle portion, the wheel portion including an upper peak section and a lower peak section, the axle portion including opposing outer ends, each end of the axle portion contains an arm extending from an underside of the axle portion to a base support traversing the arms, one of the arms including an outer extension member, the base support having a top and bottom, the base support including a central extension member extending from the bottom of the base support, the nock sensor pivot pin being operatively associated with a nock spring that biases the nock sensor in a first pivoting direction, the upper peak section of the wheel portion being operatively positioned within the gap of the catch and configured to receive a nock affixed to a rearward end of an arrow, wherein when the nock sensor has not received the nock, the nock sensor extension of the sear operatively contacts the base support of the nock sensor to prevent actuation of the catch to release the bowstring for firing and wherein when the nock sensor has received the nock to permit pivoting of the nock sensor in a second direction, the base support of the nock sensor does not operatively contact the nock sensor extension of the sear enabling actuation of the catch to release the bowstring for firing; and a dry fire prevention assembly comprising a bypass block, a release switch, and a lockout pawl, the bypass block comprising a body portion having a top, a front, a rear, and outer and inner sides interconnecting the top and bottom, the outer side containing a lockout notch, a bypass arm longitudinally extending from the front and terminating at a distal end, the distal end containing a bypass key configured to operatively contact the nock sensor, the front being configured to receive an end of a bypass block spring that biases the bypass block in a rearward direction, the release switch comprising a switch base having a forward end and a rearward end, the forward end including a connection plate configured for operative connection to the bypass block, the rearward end containing a switch control for selective reciprocation of the bypass block in forward and rearward directions, wherein selective reciprocation of the bypass block in the forward direction causes the nock sensor to pivot in the second direction to disengage the base support of the nock sensor from the nock sensor extension of the sear to enable actuation of the catch to release the bowstring for firing, the lockout pawl having a forward end, a rearward end, a top, a bottom, and outer and inner sides interconnecting the top and bottom, the forward end of the lockout pawl containing a lockout pawl pivot bore extending through the top and bottom for pivotal movement of the lockout pawl about a lockout pawl pivot pin accommodated within the lockout pawl pivot bore, the inner side of the lockout pawl including an extension portion and a tapered surface terminating at the rearward end, a lockout spring biases the lockout pawl inwardly so that when the switch control has selectively reciprocated the bypass block in the rearward direction, the rearward end of the lockout pawl is disposed in the lockout notch of the bypass block preventing reciprocation of the bypass block in the forward direction.

12. The crossbow trigger system of claim 11, further comprising an adapter operatively secured to the lockout pawl, the adapter being configured for connection to a crossbow track, the crossbow track configured for sliding movement of a hook assembly, the hook assembly including a hook pin, wherein the hook pin contacts extension portion of the lockout pawl when the hook assembly is slidably positioned on the crossbow track adjacent to the catch and disengages the rearward end of the lockout pawl from the lockout notch of the bypass block to enable the switch control of the release switch to selectively reciprocate the bypass block in the forward direction.

13. The crossbow trigger system of claim 11, wherein the connection plate of the release switch is operatively connected to the top of the bypass block.

14. The crossbow trigger system of claim 11, wherein the bypass key extends inwardly from the distal end of the bypass arm and operatively contacts a rear surface of the outer extension of the nock sensor.

15. The crossbow trigger system of claim 11, wherein the top of the body portion of the bypass block is separated by a shoulder into a lower top section and an upper top section wherein the connection plate of the release switch is operatively connected to the upper top section.

16. The crossbow trigger system of claim 11, wherein the front of the body portion of the bypass block contains a recess for placement of the end of the bypass block spring.

17. The crossbow trigger system of claim 11, wherein a flat extension wall extends from the front of the body portion of the bypass block.

18. The crossbow trigger system of claim 11, further comprising a safety including a U-shaped body comprising two arms each with an upper end and a lower end, the lower end of the arms interconnected by a base member, each arm containing a safety pivot bore in axial alignment for pivotal movement of the safety about a safety pivot pin accommodated within the safety pivot bores, one or both of the upper ends include a knob configured to pivot the safety by manipulation of the knob from a safety-on position to a safety-off position, wherein in the safety-on position, the base support of the safety operatively contacts the safety ridge section of the sear to prevent actuation of the catch to release the bowstring for firing and wherein in the safety-off position the base support of the safety does not operatively contact the safety ridge of the sear to enable actuation of the catch to release the bowstring for firing.

* * * * *